US012523436B2

(12) United States Patent
Ye

(10) Patent No.: US 12,523,436 B2
(45) Date of Patent: Jan. 13, 2026

(54) MAGAZINE EXTENSION

(71) Applicant: Shadow Systems LLC, Plano, TX (US)

(72) Inventor: Benjamin Ni Ye, North Richland Hills, TX (US)

(73) Assignee: Shadow Systems LLC, Plano, TX (US)

( * ) Notice: Subject to any disclaimer, the term of this patent is extended or adjusted under 35 U.S.C. 154(b) by 0 days.

(21) Appl. No.: 18/985,794

(22) Filed: Dec. 18, 2024

(65) Prior Publication Data

US 2025/0116471 A1 Apr. 10, 2025

Related U.S. Application Data

(63) Continuation of application No. 17/943,501, filed on Sep. 13, 2022, now Pat. No. 12,209,838, which is a continuation-in-part of application No. 17/693,839, filed on Mar. 14, 2022, now Pat. No. 11,644,257.

(60) Provisional application No. 63/299,731, filed on Jan. 14, 2022.

(51) Int. Cl.
*F41A 9/71* (2006.01)

(52) U.S. Cl.
CPC ..... *F41A 9/71* (2013.01)

(58) Field of Classification Search
CPC ..... F41A 9/69; F41A 9/71; F41A 9/65
USPC ..... 42/49.02, 49.01, 7, 50
See application file for complete search history.

(56) References Cited

U.S. PATENT DOCUMENTS

| | | | |
|---|---|---|---|
| 5,666,752 | A | 9/1997 | Grams |
| 6,557,287 | B2 | 5/2003 | Wollmann |
| 10,190,835 | B2 | 1/2019 | Hsu et al. |
| 10,852,086 | B1 | 12/2020 | Hills et al. |
| 11,168,954 | B1 | 11/2021 | Spykerman et al. |
| 11,204,212 | B2 | 12/2021 | Lee |
| 11,644,257 | B1 | 5/2023 | Roe et al. |

FOREIGN PATENT DOCUMENTS

| | | |
|---|---|---|
| WO | 2023137237 | 7/2023 |
| WO | 2024059065 | 3/2024 |

OTHER PUBLICATIONS

Roe, Richard Trevor Simpson: International Search Report and Written Opinion for Application No. PCT/ US2023/060147 filed Jan. 5, 2023, mailed Apr. 24, 23, 11 pages.
Ye, Benjamin Ni: International Search Report and Written Opinion for PCT/US23/032533, filed Sep. 12, 2023, mailed Dec. 8, 2023, 9 pages.

*Primary Examiner* — Reginald S Tillman, Jr.
(74) *Attorney, Agent, or Firm* — Kim IP Law Group LLC

(57) ABSTRACT

A magazine extension is provided. The magazine extension includes a baseplate structured to receive a lower open end of a magazine, the baseplate having a laterally extending through-bore; a side bracket structured to couple to the baseplate for securing the magazine, the side bracket having a laterally extending through-bore; and a locking pin insertable within both the through-bore of the baseplate and the through-bore of the side bracket to lock the side bracket to the baseplate.

18 Claims, 27 Drawing Sheets

MAGAZINE EXTENSION

CROSS-REFERENCE TO RELATED APPLICATIONS

This application is a continuation of U.S. patent application Ser. No. 17/943,501, filed on Sep. 13, 2022, entitled "Magazine Extension," which is a continuation in-part of U.S. patent application Ser. No. 17/693,839, filed on Mar. 14, 2022, entitled "Auto-Locking Magazine Extension," now U.S. Pat. No. 11,644,257, which claims the benefit under 35 U.S.C. § 119(e) to U.S. Provisional Application No. 63/299,731, filed Jan. 14, 2022, and entitled "Auto-Locking Magazine Extension." U.S. patent application Ser. Nos. 17/943,501 and 17/693,839, U.S. Pat. No. 11,644,257, and U.S. Provisional Application No. 63/299,731 are assigned to the assignee of the present application.

BACKGROUND OF THE INVENTION

Magazine extensions for increasing the capacity of firearm magazines are known. Such extensions typically operate by coupling to a lower open end of a magazine to increase the length and volume thereof and provide more room for additional rounds. Teleconference systems may utilize communication networks, including but not limited to the internet, to connect communication devices such as computers, tablet computers, and/or smartphones.

Since firearms are subject to substantial forces during operation, such as those caused by recoil or by dropping the firearm or magazine on a hard surface, it is desirable that a magazine extension be affixed to a magazine in a substantially robust and secure manner that prevents dislodgment. It is also desirable that the locking mechanism and associated components of the extensions do not interfere with the internal workings of the magazine, such as the magazine spring and follower. Since dirt and debris accumulated during operation of a firearm can hinder reliability of magazines and extensions, users also strongly prefer extensions that can be affixed to or removed from a magazine in the field in a toolless (or near tool less) fashion.

SUMMARY

In accordance with an exemplary embodiment of the subject disclosure, a magazine extension is provided. The magazine extension includes a baseplate structured to receive a lower open end of a magazine, the baseplate having a laterally extending through-bore; a side bracket structured to couple to the baseplate for securing the magazine, the side bracket having a laterally extending through-bore; and a locking pin insertable within both the through-bore of the baseplate and the through-bore of the side bracket to lock the side bracket to the baseplate.

In accordance with an aspect of the subject disclosure, the baseplate includes a securing slot sized to receive a rail of the magazine.

In accordance with another aspect of the subject disclosure, the baseplate includes a floor having an upper surface positioned to engage a magazine spring of the magazine.

In accordance with still another aspect of the subject disclosure, the baseplate includes a post receptacle and the side bracket includes a post structured to be closely received within the post receptacle.

In accordance with yet another aspect of the subject disclosure, the locking pin includes a first portion having a first diameter, a second portion having a second diameter smaller than the first diameter, and a stopping surface at an interface between the first portion and the second portion.

In accordance with still another aspect of the subject disclosure, the through-bore of the baseplate includes a first bore having a first diameter, a second bore having a second diameter smaller than the first diameter, and a pin stop at an interface between the first bore and the second bore.

In accordance with yet another aspect of the subject disclosure, the through-bore of the side-bracket is provided on the post of the side bracket.

In accordance with still another aspect of the subject disclosure, the through-bore of the side bracket is aligned with the through-bore of the baseplate when the post is closely received within the post receptacle of the baseplate.

In accordance with yet another aspect of the subject disclosure, the through-bore of the side bracket is misaligned with the through-bore of the baseplate when the post is closely received within the post receptacle of the baseplate.

In accordance with still another aspect of the subject disclosure, the through-bore of the side bracket includes a first bore having a first diameter, a second bore having a second diameter smaller than the first diameter, and a pin stop at an interface between the first bore and the second bore.

In accordance with yet another aspect of the subject disclosure, the side bracket includes a main body with an engagement end for engaging a proximal side of the magazine.

In accordance with still another aspect of the subject disclosure, the side bracket includes a stopping end to close an open end of the securing slot.

In accordance with another exemplary embodiment of the subject disclosure, a magazine extension is provided. The magazine extension includes a baseplate structured to receive a lower open end of a magazine, the baseplate having a proximal end, a distal end, a post receptacle at the proximal end, a laterally extending through-bore intersecting the post receptacle at the proximal end, and two securing slots sized to receive respective rails of the magazine, each of the securing slots having an open end; a side bracket structured to couple to the baseplate for securing the magazine, the side bracket having a post structured to be closely received within the post receptacle of the baseplate, a laterally extending through-bore on the post, an engagement end for engaging a proximal side of the magazine, and two stopping ends to respectively close the open ends of the securing slots; and a locking pin insertable within both the through-bore of the baseplate and the through-bore of the side bracket to lock the side bracket to the baseplate.

Teleconference systems may permit communication devices to share visual imagery and audio data associated with a speaking user with other communication devices. However, multi-device and multi-user teleconferences face several challenges in automatically generating and storing transcripts of the teleconference. By way of example and not of limitation, teleconference systems may be unable to rectify discrepancies in transcripts generated by separate communication devices, and may also fail to make accessible a master text transcript of the teleconference quickly and easily.

BRIEF DESCRIPTION OF THE DRAWINGS

The following detailed description of an exemplary embodiment of the subject disclosure will be better understood when read in conjunction with the appended drawings.

For the purpose of illustrating the present disclosure, there is shown in the drawings an exemplary embodiment. It should be understood, however, that the subject application is not limited to the precise arrangements and instrumentalities shown.

DETAILED DESCRIPTION

Reference will now be made in detail to an exemplary embodiment of the subject disclosure illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as upper, lower, top, bottom, above, below and diagonal, are used with respect to the accompanying drawings. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

"Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more exemplary embodiments. One skilled in the relevant art will recognize, in light of the description herein, that the subject disclosure can be practiced without one or more of the specific features or advantages of a particular exemplary embodiment. In other instances, additional features and advantages may be recognized in certain exemplary embodiments that may not be present in all exemplary embodiments of the present disclosure.

Figure 1:
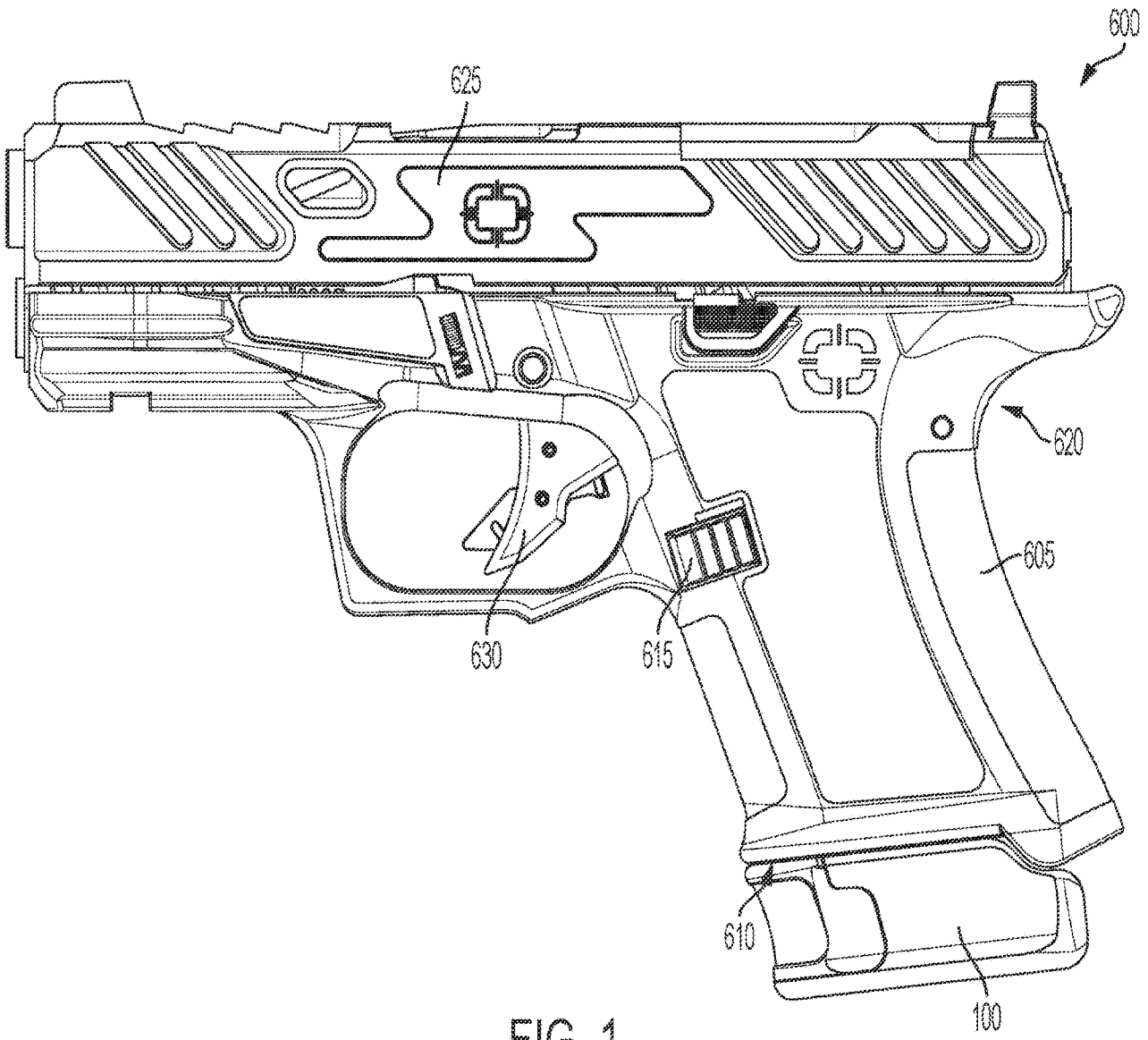
FIG. 1 is a side view of a firearm assembly including a firearm with a magazine and an auto-locking magazine extension in accordance with an exemplary embodiment of the subject disclosure.
Figure 2:
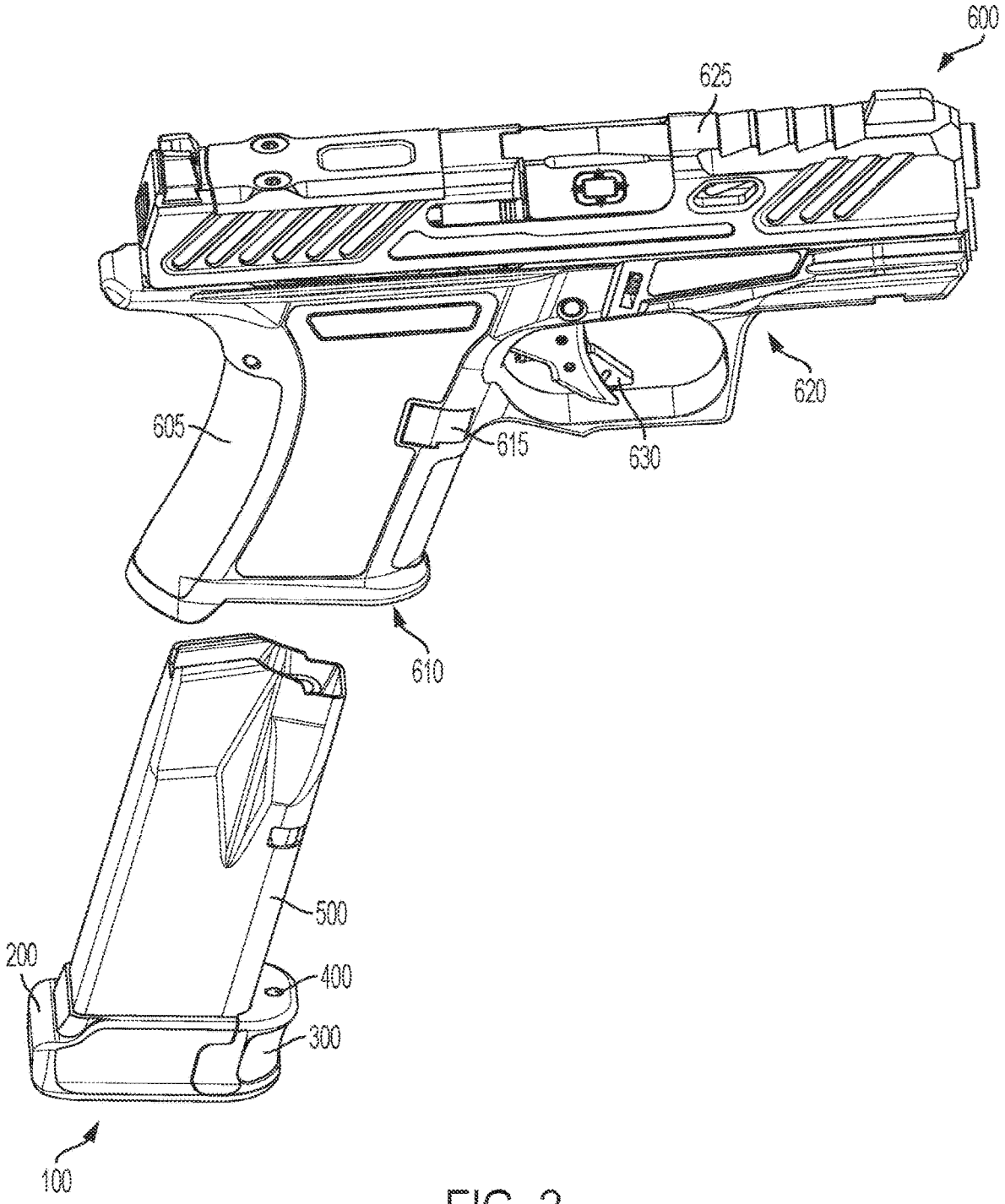
FIG. 2 is an exploded perspective view of the firearm assembly of FIG. 1.
Figure 3:
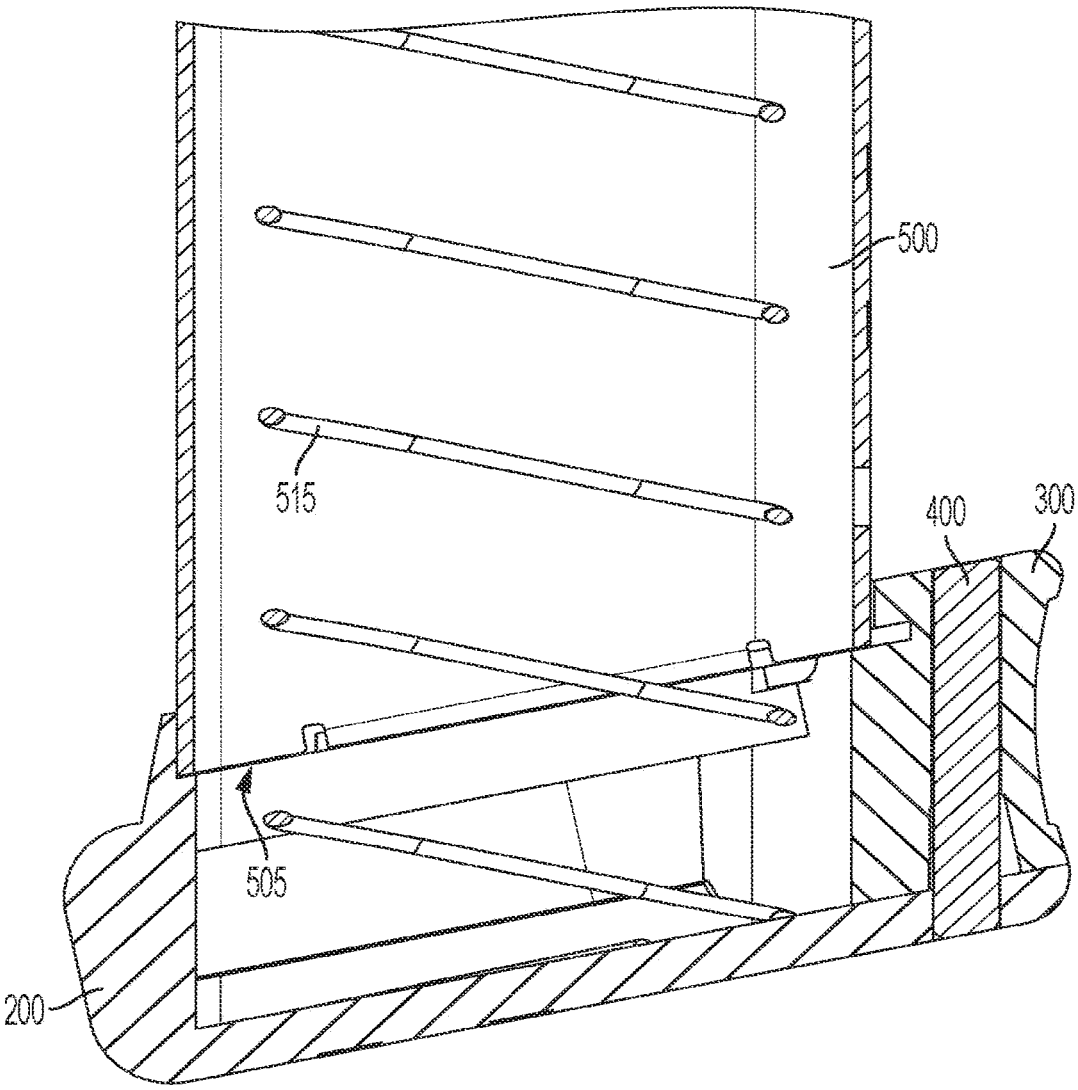
FIG. 3 is a side sectional view of the magazine and magazine extension of FIG. 1.
Figure 4:
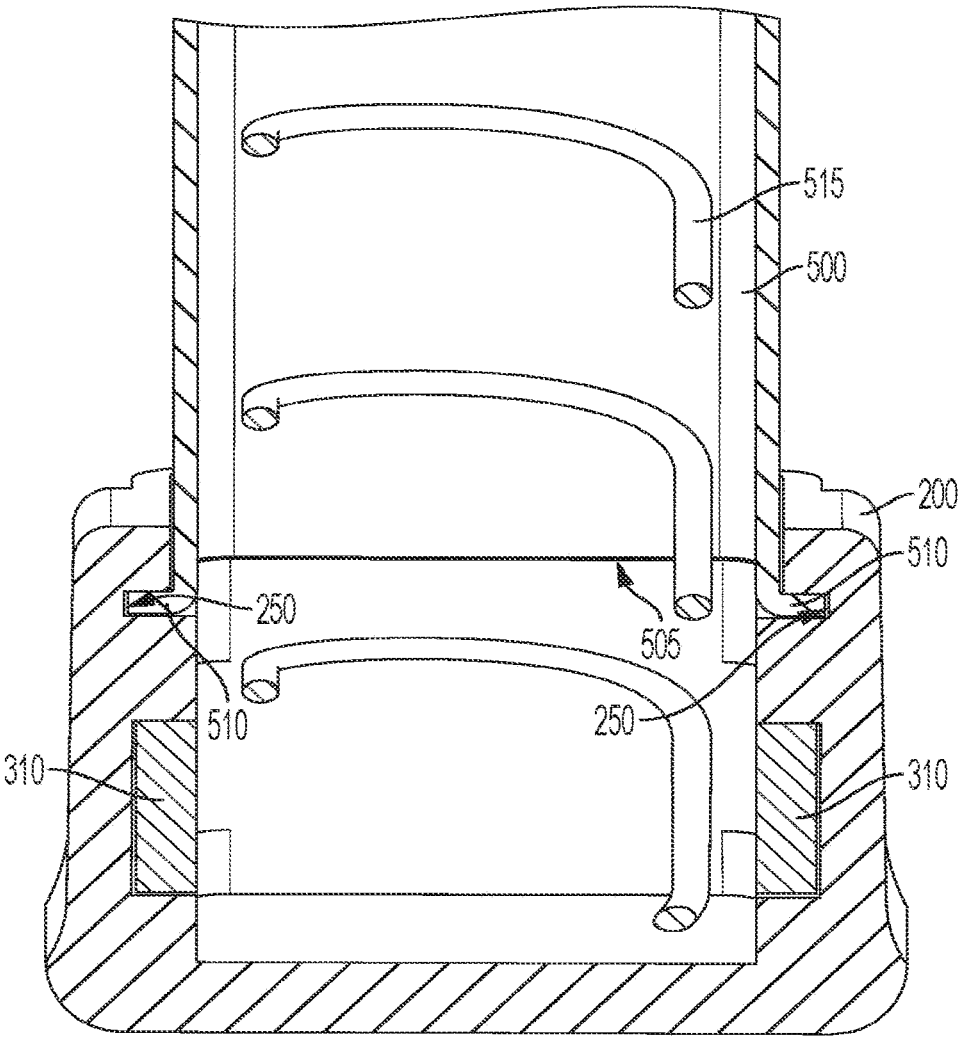
FIG. 4 is a front sectional view of the magazine and magazine extension of FIG. 1.
Figure 5:
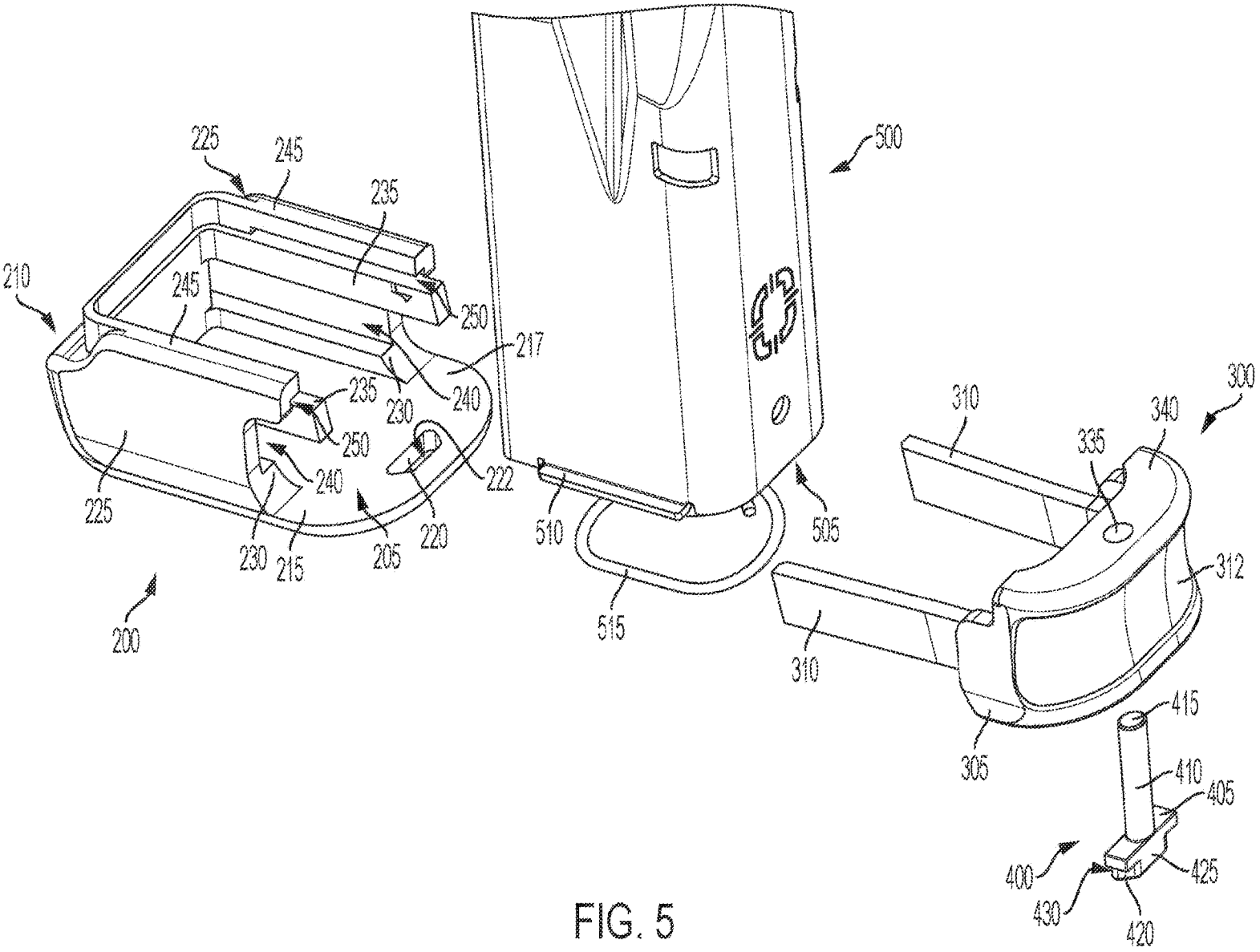
FIG. 5 is an exploded perspective view of the magazine and magazine extension of FIG. 1.
Figure 6:
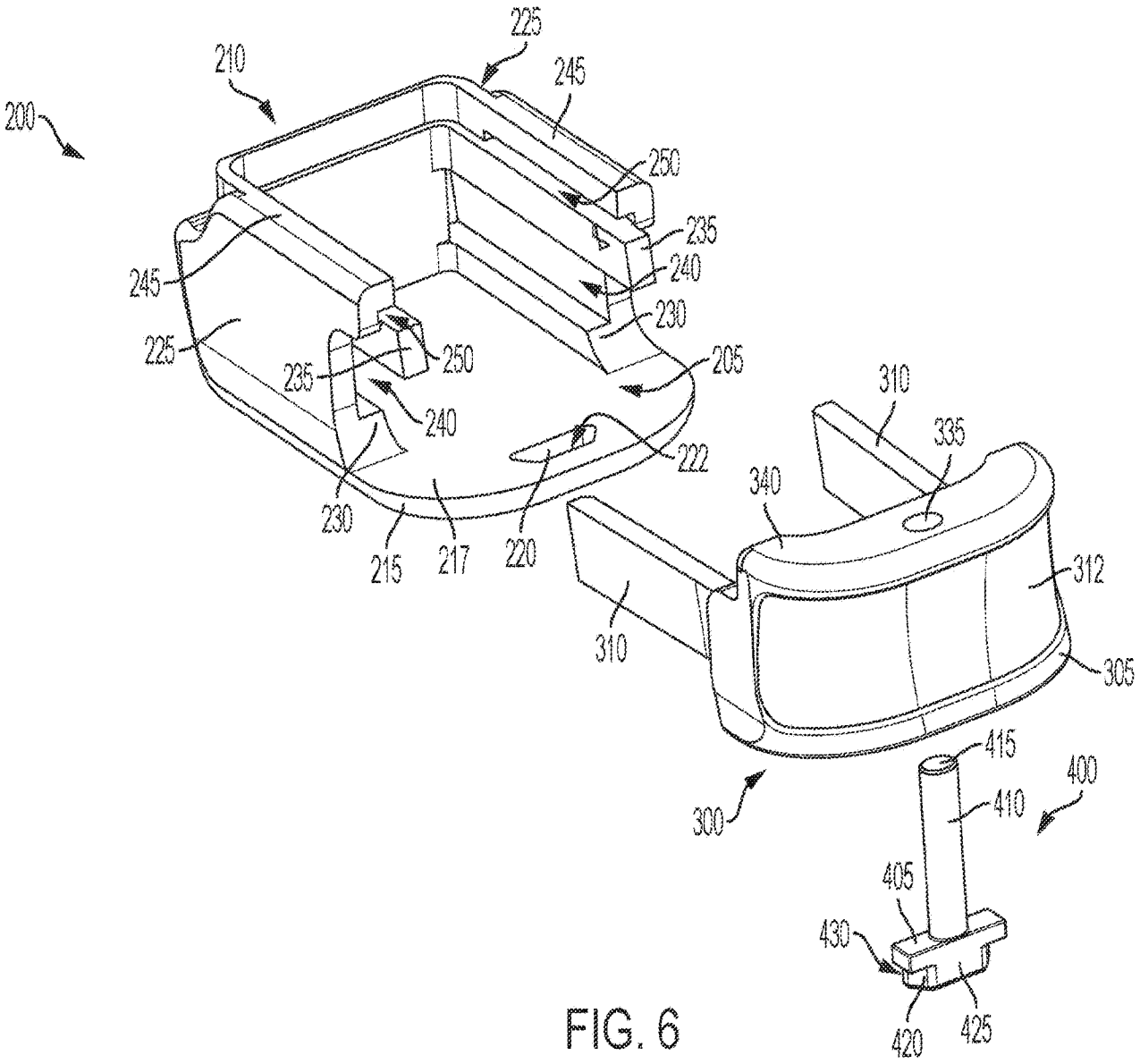
FIG. 6 is an exploded perspective view of the magazine extension of FIG. 1.
Figure 7:
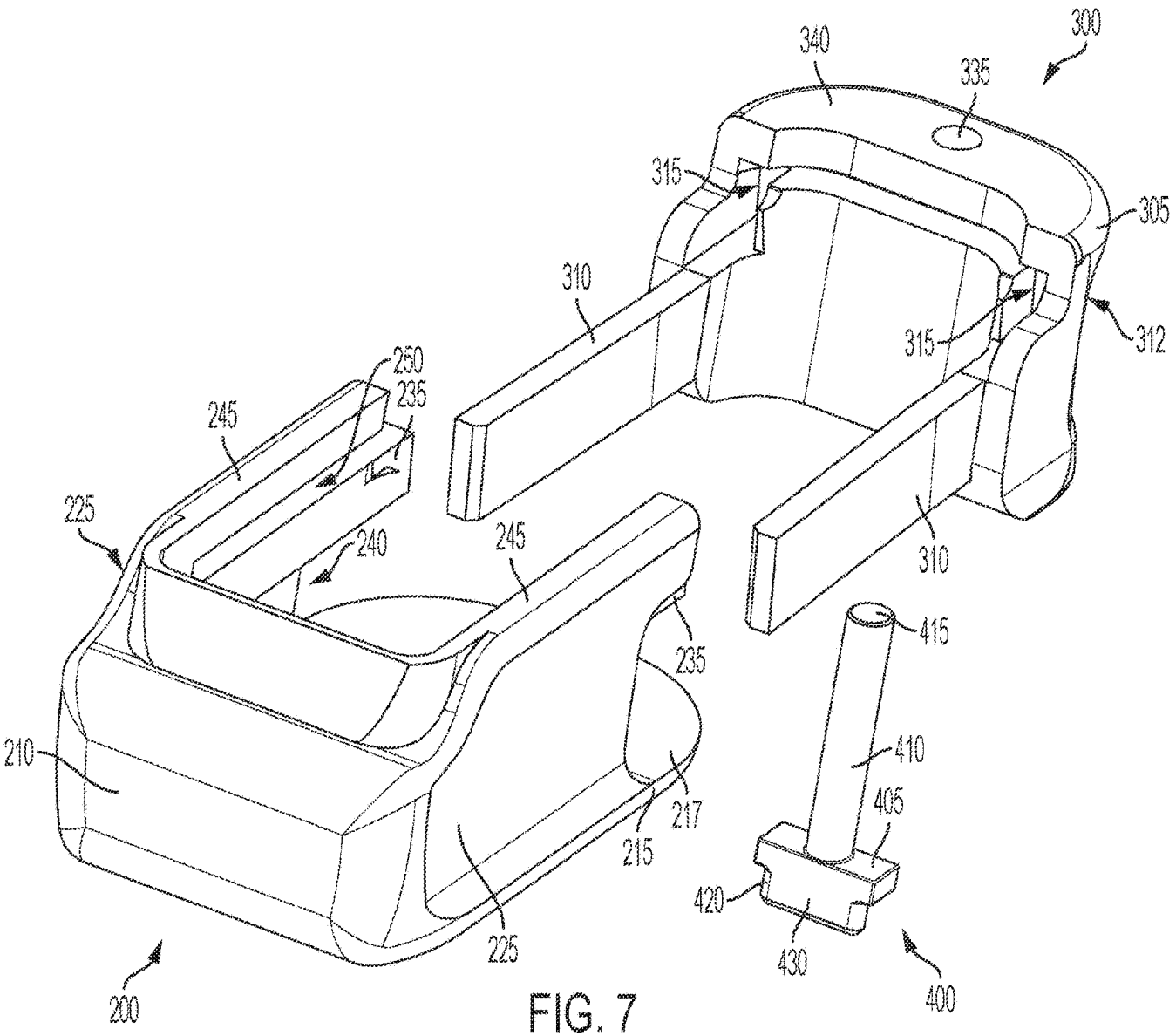
FIG. 7 is another exploded perspective view of the magazine extension of FIG. 1.
Figure 8:
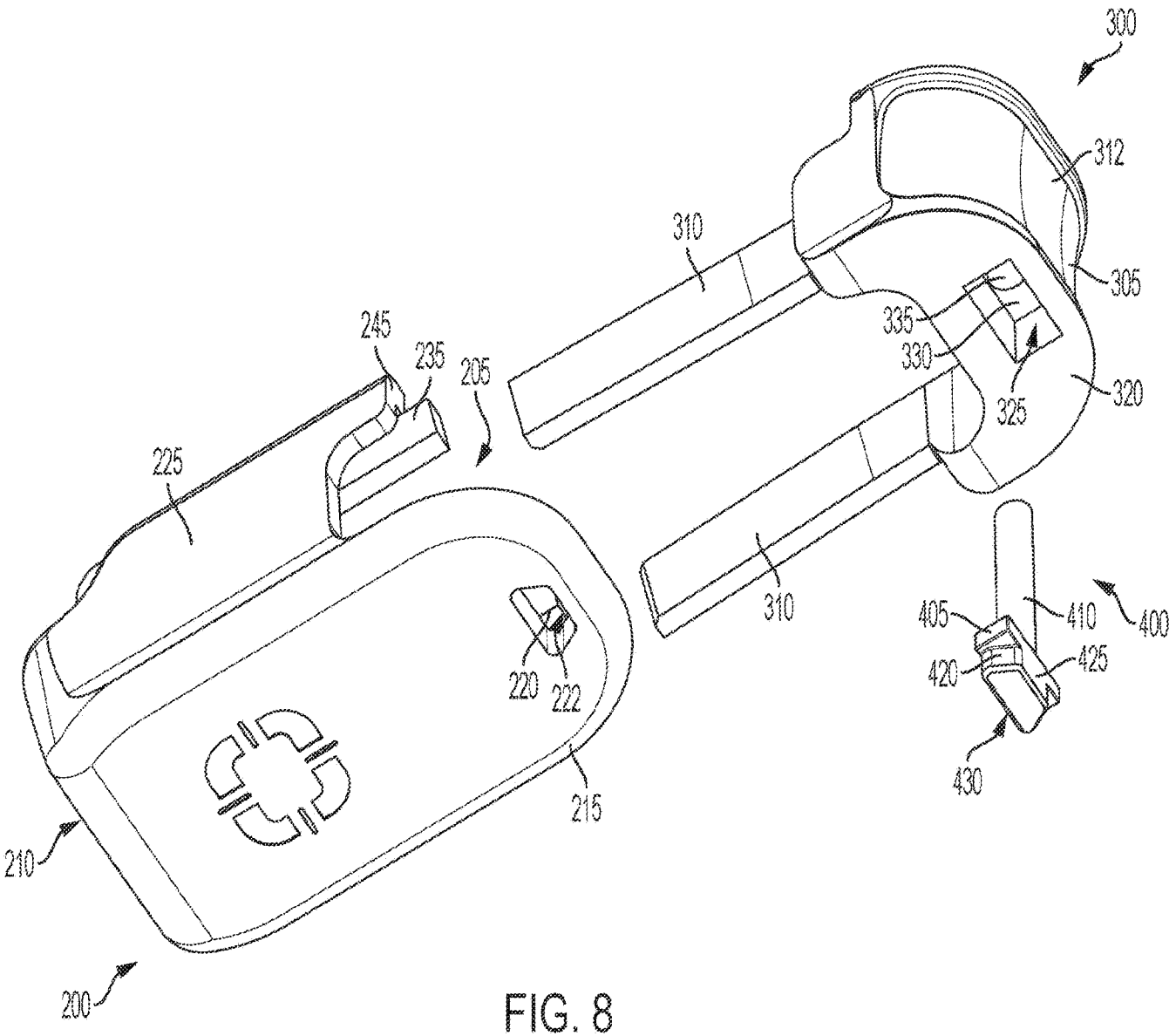
FIG. 8 is still another exploded perspective view of the magazine extension of FIG. 1.

Referring now to the Figures, there is shown an exemplary auto-locking magazine extension 100 in accordance with the subject disclosure. Magazine extension 100 increases the round capacity of a magazine 500 of handgun 600 or other firearm, such as a rifle or shotgun. As best shown in FIGS. 1 and 2, handgun 600 includes a receiver assembly 620 having a hollow handgrip 605 sized to receive magazine 500, a magazine release button 615 on handgrip 605, a slide 625 coupled to the upper portion of receiver assembly 620 and a trigger assembly 630 operable to fire rounds stored in magazine 500. Handgun 600 also includes other well-known components and structures not shown or described herein.

As shown in FIGS. 3-10, magazine extension 100 includes a baseplate 200 for receiving an open end 505 of magazine 500, a side bracket 300 structured to releasably couple to baseplate 200 for securing magazine 500 thereto and a locking pin 400 for locking side bracket 300 to baseplate 200.

As best shown in FIGS. 5 through 8, baseplate 200 includes an open proximal end 205, a closed and rounded distal end 210, a beveled floor 215 with an upper surface 217 extending between proximal and distal ends 205, 210 and having a trapezoid-shaped window 220 at proximal end 205, and two side walls 225 at opposite lateral sides of floor 215 and extending between proximal and distal ends 205, 210. The inner face of each wall 225 includes a lower lateral protrusion 230 and a guide 235 which together form a guide channel 240 extending between proximal and distal ends 205, 210. Each guide 235 also cooperates at its top end with a lateral and inwardly projecting lip 245 to form a securing slot 250 sized to receive rails 510 of magazine 500. Baseplate 200 and its features are formed integrally into one monolithic piece (such as by injection molding), though it should be appreciated that baseplate 105 may be formed from multiple separate pieces and be constructed from any material(s) suitable for its intended purpose.

Side bracket 300 includes a main body 305 and two legs 310 extending distally from opposite sides of main body 305, each of which is sized and positioned to closely engage a respective guide channel 240 of baseplate 200. Main body 305 includes a curved proximal face 312, two lateral and distally facing receipt channels 315, a lower surface 320, a receptacle 325 extending upwardly from lower surface 320 and having an upper face 330, and a cylindrical through-bore 335 communicating with receptacle 325 and extending upwardly therefrom and terminating at an upper surface 340. Like baseplate 200, side bracket 300 and its features are formed integrally into one monolithic piece, though it should be appreciated that side bracket 300 may be formed from multiple separate pieces and be constructed from any suitable material(s).

Locking pin 400 includes a stop 405, a cylindrical shaft 410 extending upwardly from stop 405 and terminating at an upper face 415, and a trapezoid-shaped key 420 extending downwardly from stop 405 and having respective proximal and distal faces 425, 430.

To ensure proper alignment of side bracket 300 with respect to baseplate 200, guide channels 240 of baseplate 200 closely receive legs 310 of side bracket 300 and receipt channels 315 of side bracket 300 closely receive the proximal ends of guides 235. This ensures that lower surface 320 of side bracket 300 closely engages upper surface 217 of floor 215 of baseplate 200 and aligns receptacle 325 of side bracket 300 with window 220 of baseplate 200. Shaft 410 of locking pin 400 extends upwardly through bore 335 of side bracket 300, with stop 405 being positioned within receptacle 325. When extension 100 is secured to magazine 500, upper face 330 of receptacle 325 and upper surface 217 of floor 215 limit movement of stop 405 within receptacle 325 between a lower locked position, in which proximal face 425 of key 420 engages proximal side 222 of window 220 to prevent removal of side bracket 300 laterally from baseplate 200 (see FIG. 9), and an upper unlocked position, in which key 420 clears window 220 to allow removal of side bracket 300 laterally from baseplate 200 (see FIG. 10). By ensuring that locking pin 400 locks side bracket 300 in a lower position (rather than an upper or other position), magazine extension 100 provides enhanced robustness against inadvertent unlocking and disassembly caused by a falling magazine 500 striking a hard surface (such as when magazine release button 615 is pressed in typical fashion to allow empty magazine 500 to fall out of handgun 600 under force of gravity). In such an event, magazine 500 falls straight and typically strikes the ground in an upright position (extension 100 first), upon which inertia urges locking pin 400 even more strongly into the lower locked position. Likewise, recoil forces (which typical jolt a firearm upwards) may more strongly seat locking pin 400 in the lower locked position.

Key 420 of locking pin 400 is trapezoid-shaped and sized to engage trapezoid-shaped window 220 in the assembled state only when locking pin 400 is in a specific rotational orientation. This ensures that upper face 415 of pin 400 (which is cut at an angle with respect to the axis of shaft 410) lies flush with upper surface 340 of side bracket 300 when pin 400 is in the lower locked position. While key 420 and window 220 are trapezoid-shaped, it should be appreciated that these features may be designed with different shapes or keying features to ensure proper rotational alignment of pin 400 or, alternatively, these features need not be keyed at all, such as with respect to embodiments that do not require a specific rotational orientation of pin 400. Further, although shaft 410 and through-bore 335 are generally cylindrical with cross-sections that are substantially circular in shape, it should be appreciated that these features may be designed to have different cross-sections, such as, e.g., square or triangle shaped cross-sections, and that various embodiments of the subject disclosure are not intended to be limited to any particular cross-sectional shape of shaft 410 or through-bore 335.

Figure 9:
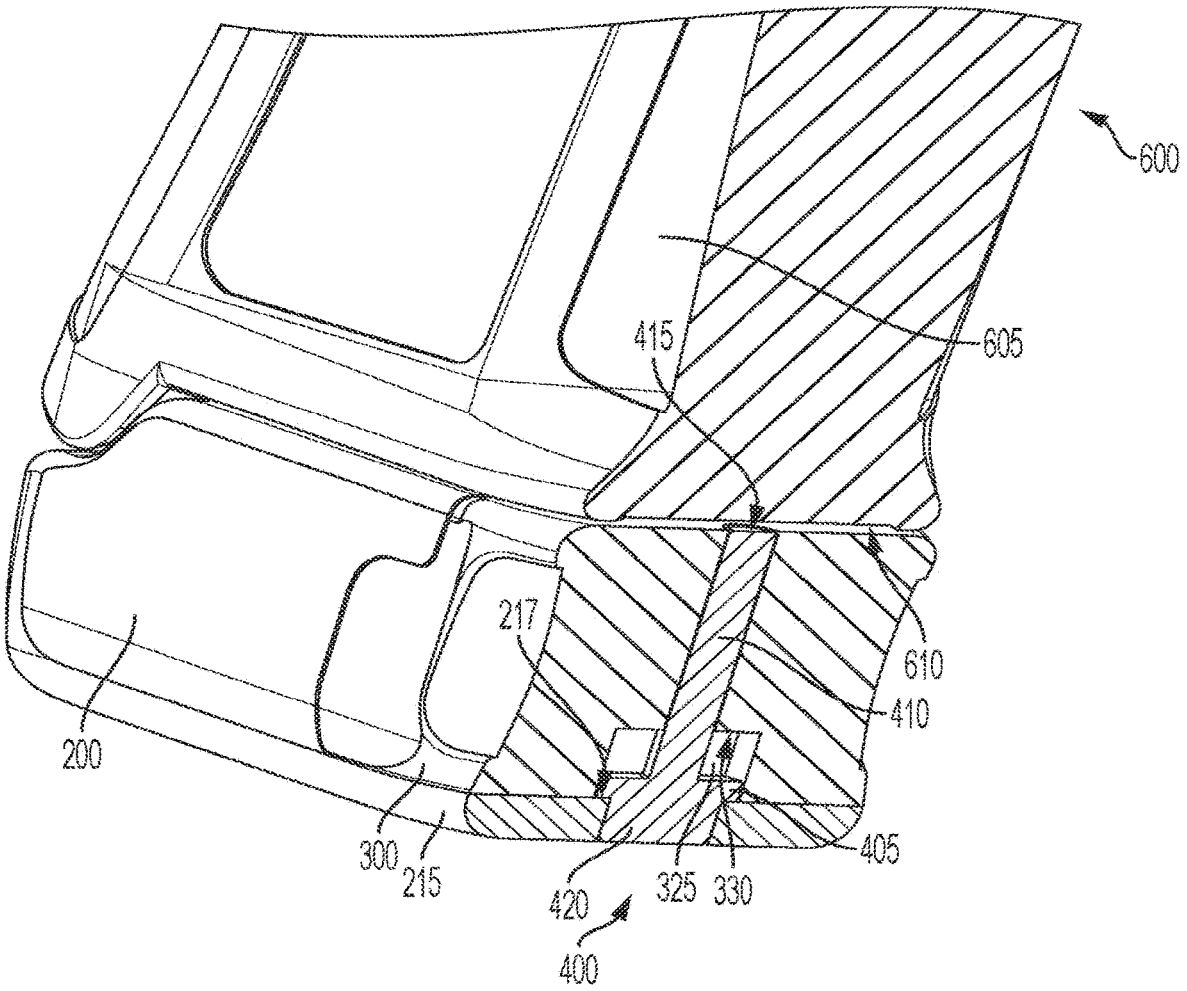
FIG. 9 is a perspective sectional view of the firearm assembly of FIG. 1 showing a locking pin in a lower locked position.
Figure 10:
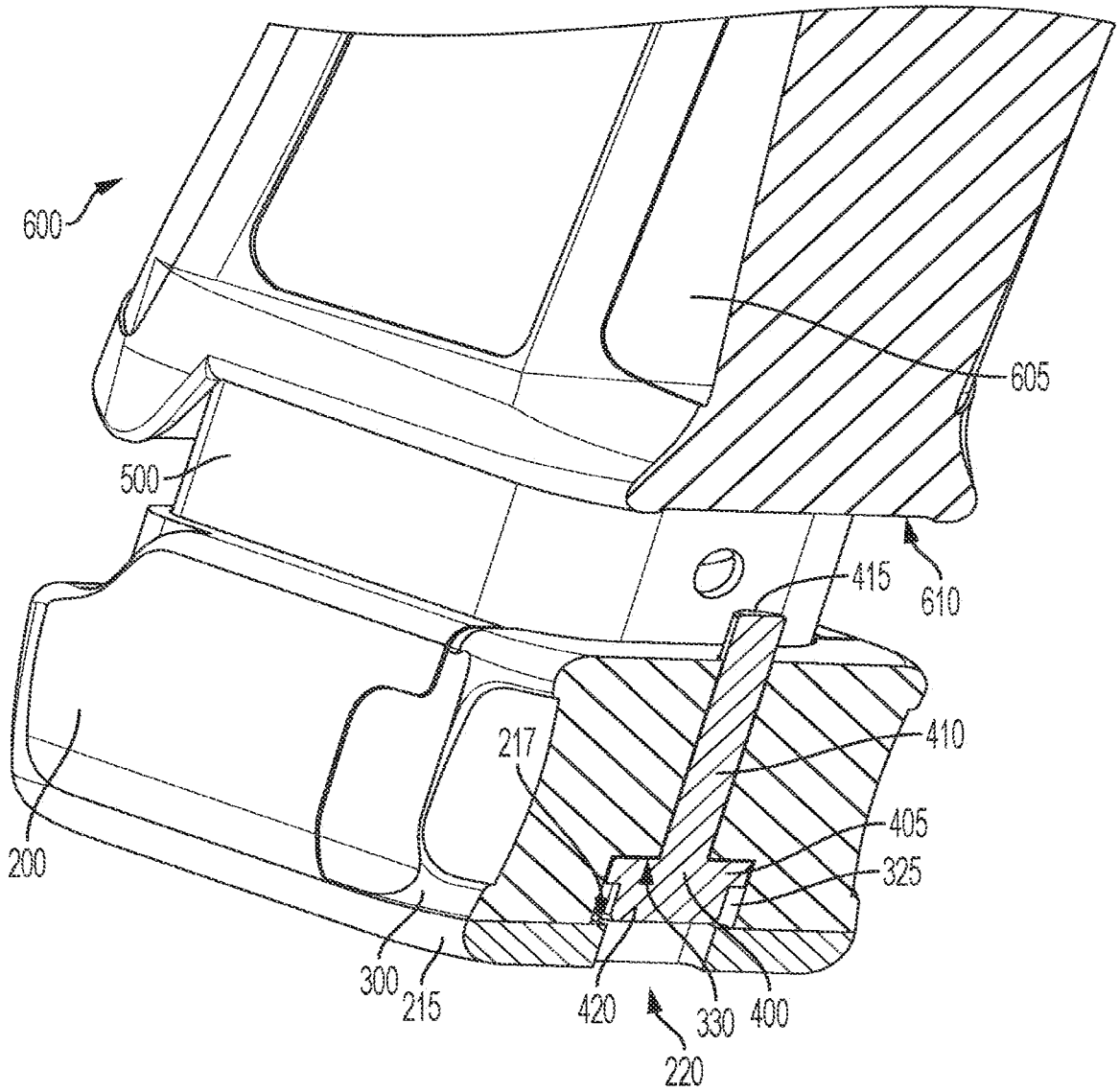
FIG. 10 is a perspective sectional view of the firearm assembly of FIG. 1 showing the locking pin in an upper unlocked position and the magazine removed partially from the firearm.

As best shown in FIGS. 9-10, when magazine 500 with magazine extension 100 is inserted and secured within handgrip 605 of handgun 600, a lower surface 610 of handgrip 605 automatically locks side bracket 300 to baseplate 200 by engaging with upper face 415 of locking pin 400 to ensure pin 400 cannot be moved into the upper unlocked position during operation of handgun 600 (see FIG. 9). However, to the extent locking pin 400 is inserted into side bracket 300 in the wrong rotational orientation, or side bracket 300 is not fully inserted into baseplate 200 to align key 420 with window 220, key 420 of pin 400 will not engage window 220, thereby maintaining locking pin 400 rigidly in the upper unlocked position. In this position, upper face 415 of shaft 410 engages and stops handgrip 605 at some distance above upper surface 340 of side bracket 300 to prevent magazine 500 from being fully inserted and secured within handgrip 605. This provides a safety feature that prohibits installation of magazine 500 into handgun 600 when magazine extension 100 is not properly assembled and secured to magazine 500. In the event locking pin 400 and/or side bracket 300 are damaged and become dislodged from baseplate 200, handgun 600 still may be safely operated at least temporarily, as biasing forces exerted against floor 215 by magazine spring 515 produce frictional forces that maintain rails 510 of magazine 500 within securing slots 250 of baseplate 200.

Figure 11:
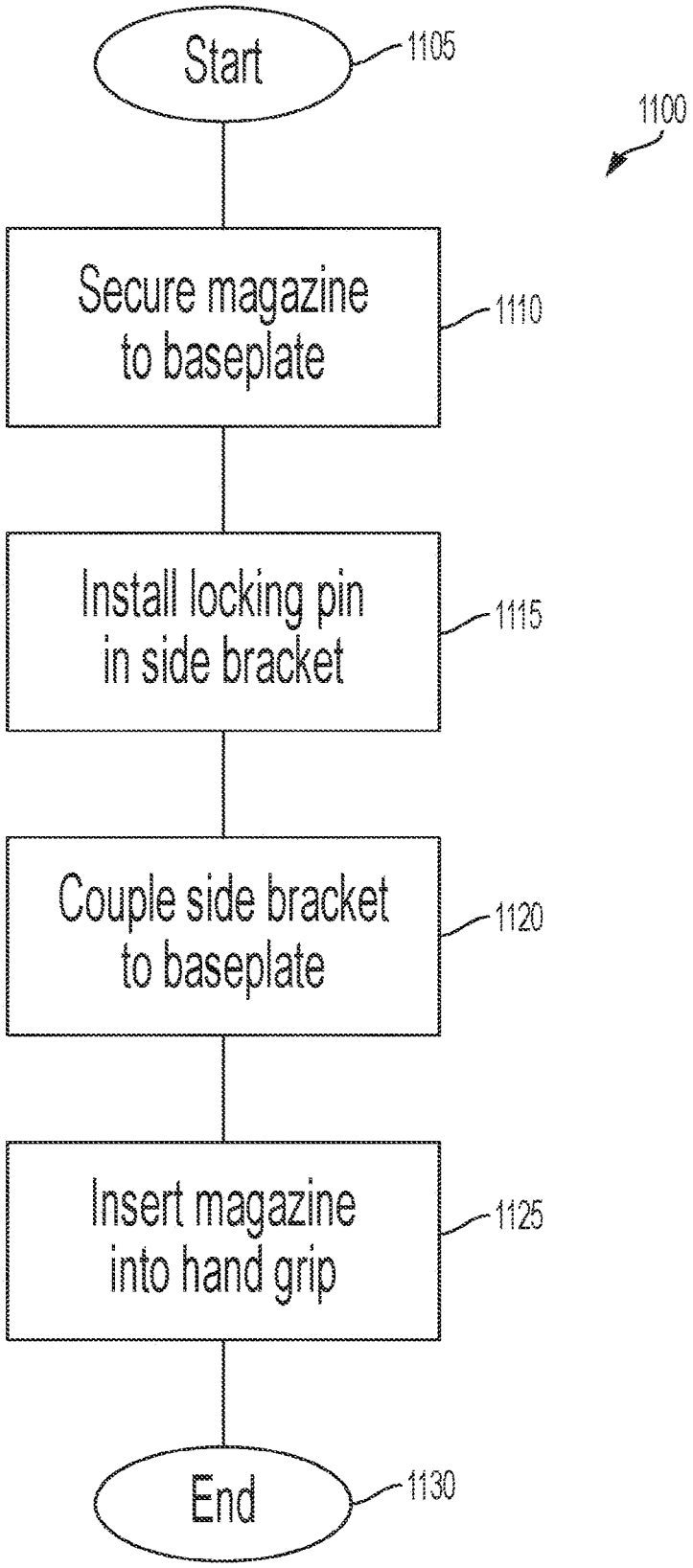
FIG. 11 is a diagram detailing a process for assembling the magazine extension of FIG. 1 on a magazine of a handgun.

Referring now to FIG. 11, there is shown a diagram detailing a process 1100 for assembling magazine extension 100 on magazine 500 of handgun 600. The process begins at step 1105 and proceeds to step 1110, at which a user compresses magazine spring 515 of magazine 500, slides rails 510 of magazine 500 distally into securing slots 250 of baseplate 200, and releases spring 515 to permit engagement of spring 515 with floor 215 of baseplate 200. The process then proceeds to step 1115. At this step, the user inserts shaft 410 of locking pin 400 upwardly into through-bore 335 of side bracket 300 until key 420 is fully maintained within receptacle 325. Then, at step 1120, the user inserts legs 310 of side bracket 300 laterally into guide channels 240 of baseplate 200 until key 420 of pin 400 aligns with window 220 of baseplate 200. The process then proceeds to step 1125, at which the user presses upper face 415 of shaft 410 downwardly to urge locking pin 400 into the lower locked position, thereby locking side bracket 300 to baseplate 200. Alternatively, locking pin 400 may be secured into the locked position by inserting and securing magazine 500 within handgrip 605 of handgun 600. Insertion of magazine 500 in this manner causes lower surface 610 of handgrip 605 to engage with upper face 415 of shaft 410 to urge locking pin 400 downwardly into the locked position. In other embodiments, locking pin 400 simply falls downwardly into the locked position under force of gravity when key 420 of locking pin 400 aligns with window 220 of baseplate 200. In still other embodiments, a biasing member (such as a compression spring) is positioned within receptacle 325 between stop 405 of pin 400 and upper face 330 of receptacle 325 to provide a biasing force to urge pin 400 into the lower locked position when key 420 and window 220 align. The process then ends at step 1130.

Figure 12:
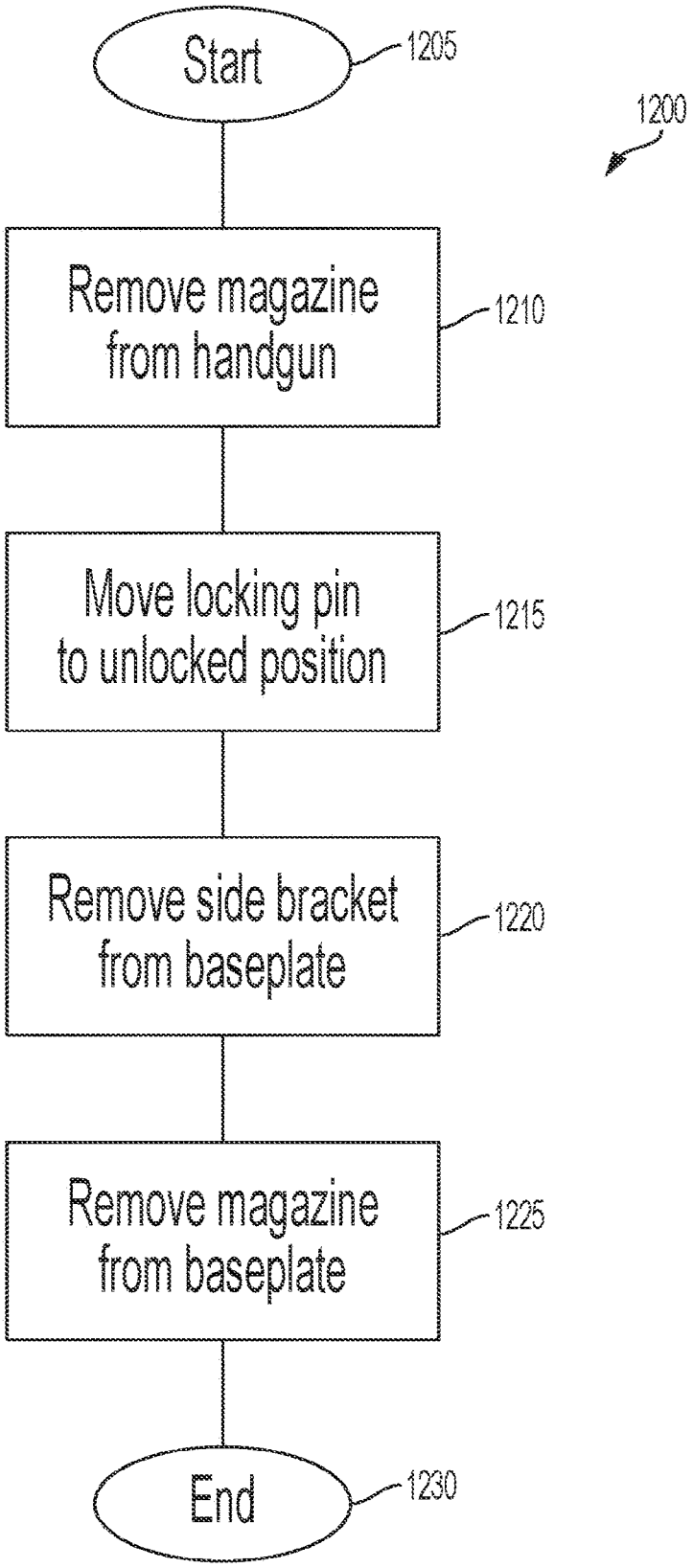
FIG. 12 is a diagram detailing a process for disassembling and removing the magazine extension of FIG. 1 from a magazine of a handgun.

Referring now to FIG. 12, there is shown a diagram detailing a process 1200 of removing magazine extension 100 from magazine 500 of handgun 600. The process begins at step 1205 and proceeds to step 1210, at which a user removes magazine 500 from handgun 600 by depressing the magazine release button 615 of firearm 600 and sliding magazine 500 downwardly out of handgrip 605. The process then proceeds to step 1215. At this step, the user inserts a fingernail, pin punch, ball point pen or other readily available tool or structure into window 220 to urge locking pin 400 upwardly into the upper unlocked position, thereby disengaging key 420 from window 220 of baseplate 200. Then, at step 1220, the user removes side bracket 300 by sliding it proximally with respect to baseplate 200. With side bracket 300 removed, the process proceeds to step 1225, at which the user compresses magazine spring 515 slightly and removes magazine 500 from baseplate 200 by sliding it proximally until rails 510 fully clear securing slots 250 of baseplate 200. The process then ends at step 1230.

Referring now to FIGS. 13-17, there is shown another exemplary magazine extension 1300 in accordance with the subject disclosure. Similar to magazine extension 100, magazine extension 1300 increases the round capacity of magazine 500 of handgun 600 or other firearm. Magazine extension 1300 includes a baseplate 1400 for receiving open end 505 of magazine 500, a side bracket 1500 structured to releasably couple to baseplate 1400 for securing magazine 500 thereto and a cylindrically-shaped locking pin 1600 for locking side bracket 1500 to baseplate 1400.

Figure 13:
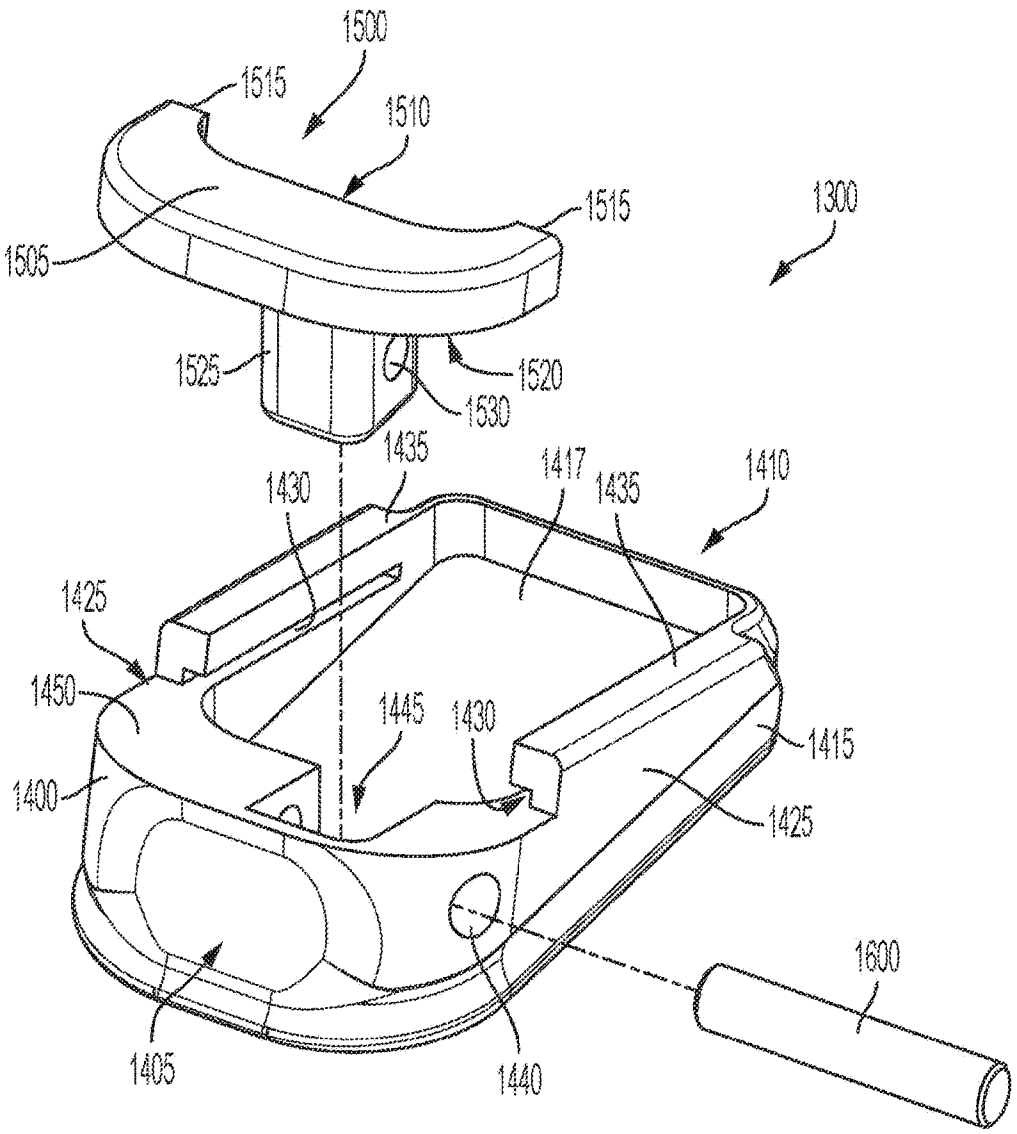
FIG. 13 is an exploded perspective view of a magazine extension in accordance with another exemplary embodiment of the subject disclosure.
Figure 14:
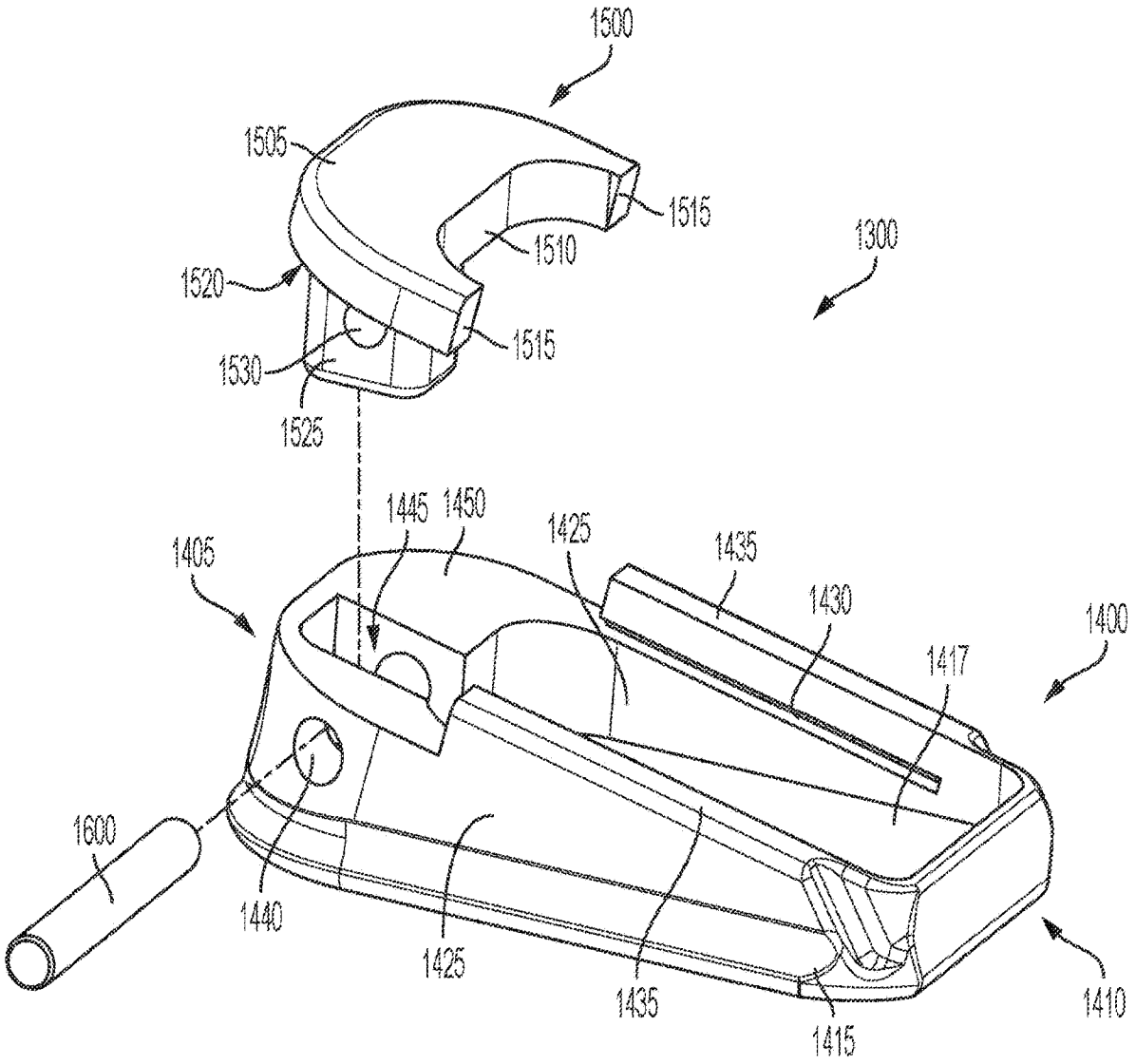
FIG. 14 is another exploded perspective view of the magazine extension of FIG. 13.
Figure 15:
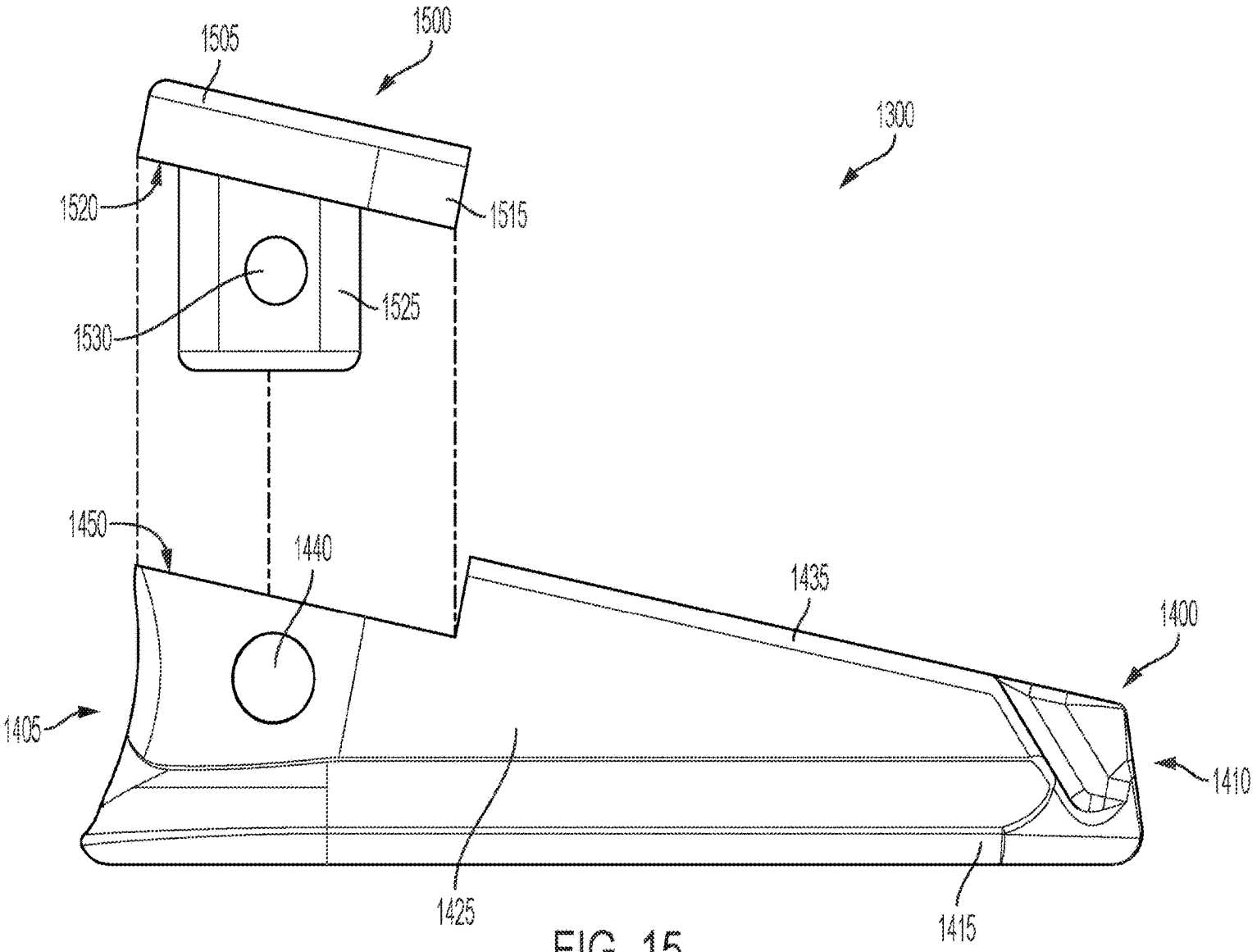
FIG. 15 is an exploded side view of a baseplate and side bracket of the magazine extension of FIG. 13.
Figure 16:
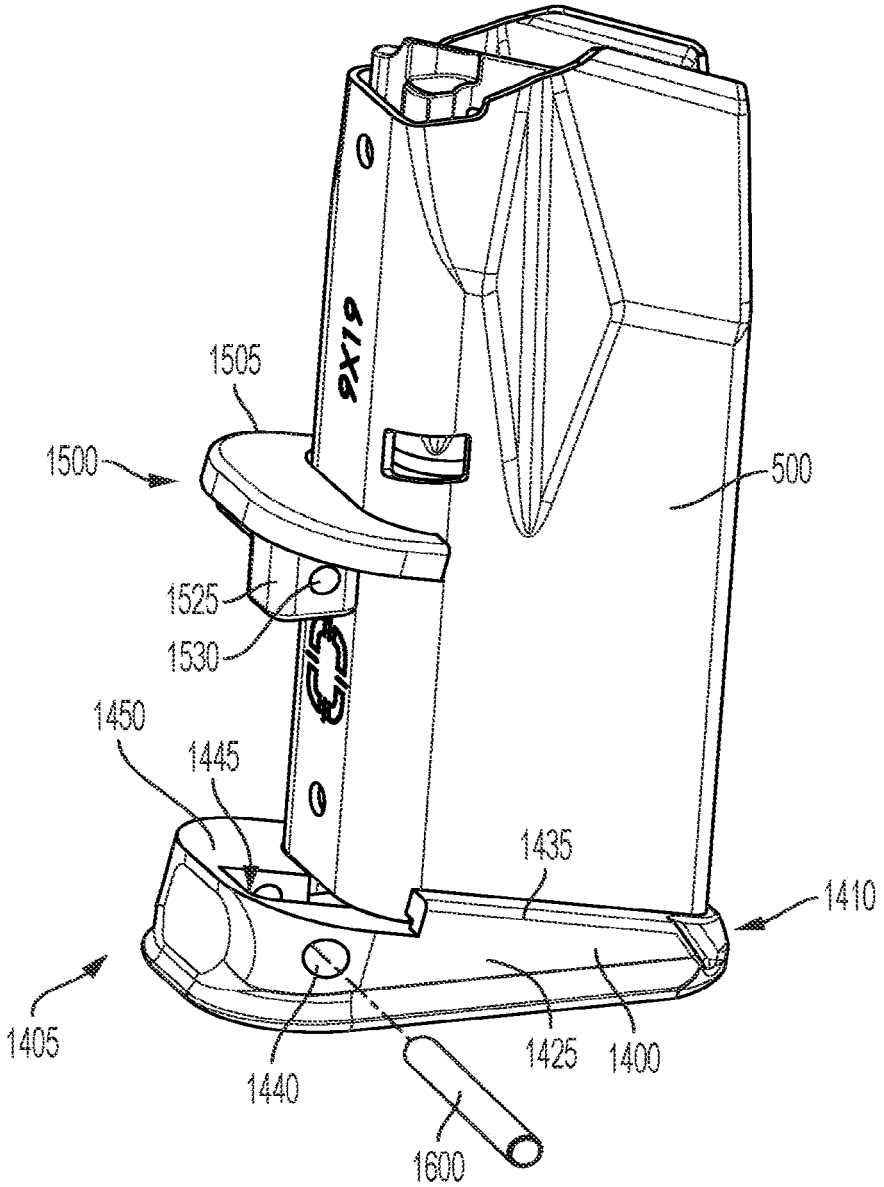
FIG. 16 is a perspective view of the magazine extension of FIG. 13 partially assembled onto a magazine.
Figure 17:
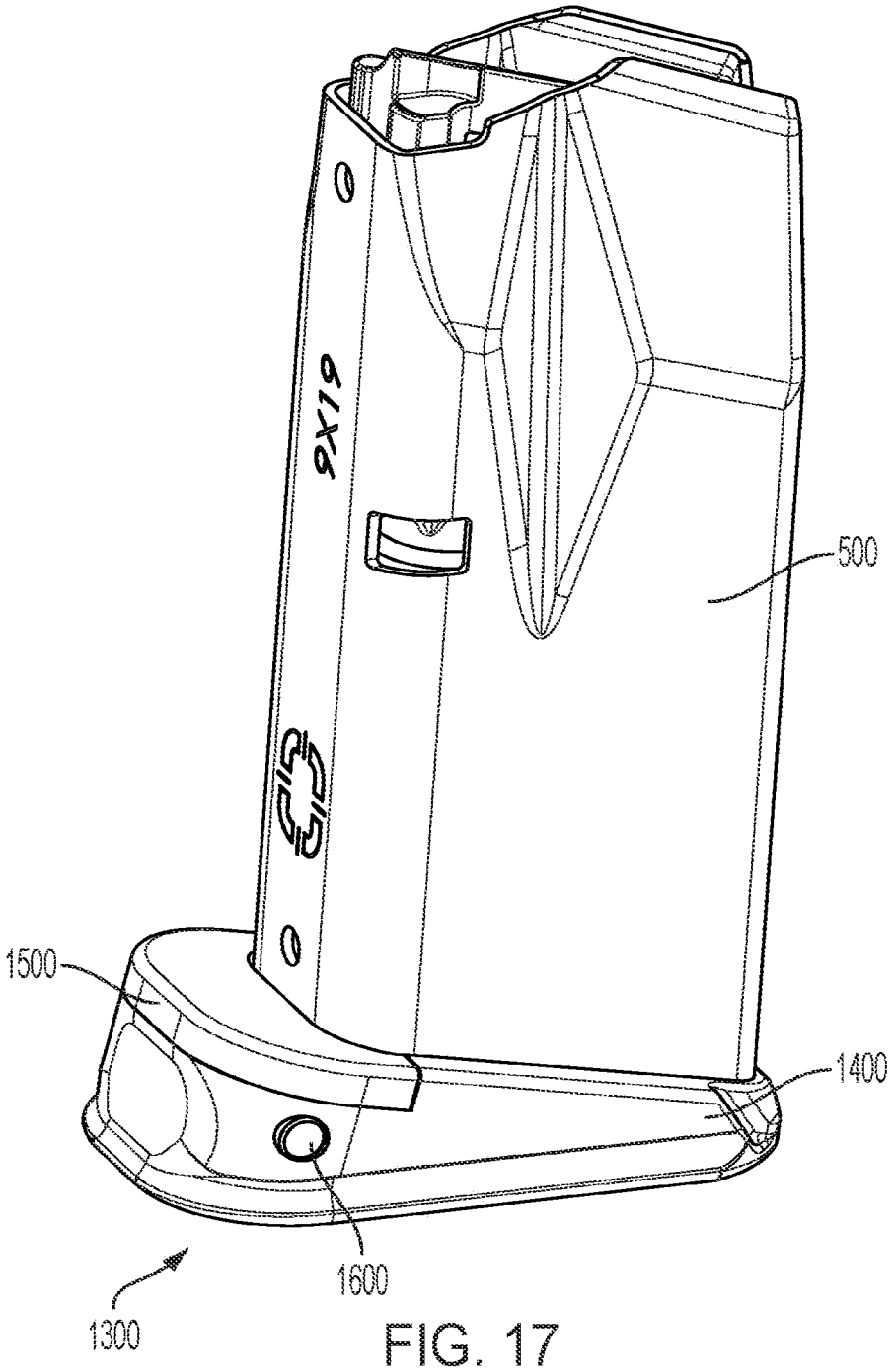
FIG. 17 is a perspective view of the magazine extension of FIG. 13 fully assembled onto a magazine.

As best shown in FIGS. 13 through 15, baseplate 1400 includes a proximal end 1405, a distal end 1410, a floor 1415 with an upper surface 1417 extending between proximal and distal ends 1405, 1410, two side walls 1425 at opposite lateral sides of floor 1415 and extending between proximal and distal ends 1405, 1410, an upwardly-facing mating surface 1450 at proximal end 1405, a post receptacle 1445 and a through-bore 1440 extending laterally through baseplate 1400 and intersecting post receptacle 1445 at proximal end 1405. Each side wall 1425 includes an inwardly projecting lip 1435 forming a securing slot 1430 sized to receive one of rails 510 of magazine 500. Baseplate 1400 and its features are formed integrally into one monolithic piece (such as by injection molding), though it should be appreciated that baseplate 1400 may be formed from multiple separate pieces and be constructed from any material(s) suitable for its intended purpose.

Side bracket 1500 includes a main body 1505 having a distally-facing engagement end 1510, two distally-facing stopping ends 1515 extending from respective lateral sides of engagement end 1510, and a downwardly-facing mating surface 1520. Side bracket 1500 further includes a post 1525 with a lateral through-bore 1530. Post 1525 extends downwardly from main body 1505 and is sized to engage with post receptacle 1445 of baseplate 1400. Like baseplate 1400, side bracket 1500 and its features are formed integrally into one monolithic piece, though it should be appreciated that side bracket 1500 may be formed from multiple separate pieces and be constructed from any suitable material(s).

When magazine extension 1300 is secured to magazine 500, post 1525 of side bracket 1500 is closely received within post receptacle 1445 of baseplate 1400, such that through-bore 1530 of side bracket 1500 aligns with through-bore 1440 of baseplate 1400. In this position, locking pin 1600 extends laterally through both through-bores 1440, 1530 to secure side bracket 1500 to baseplate 1400. When in the secured position, mating surface 1520 of side bracket 1500 engages with mating surface 1450 of baseplate 1400, engagement end 1510 of side bracket 1500 engages with the proximal side of magazine 500, and stopping ends 1515 respectively close off the open ends of securing slots 1430 of baseplate 1400, thereby securing baseplate 1400 in place relative to magazine 500 and preventing baseplate 1400 from sliding distally off rails 510 of magazine 500. It should be appreciated that through-bores 1440, 1530 may be designed to slightly misalign with one another to ensure that locking pin 1600 bends slightly when inserted within magazine extension 1300, thereby frictionally maintaining pin 1600 in place when extension 1300 is secured to magazine 500.

Figure 18:
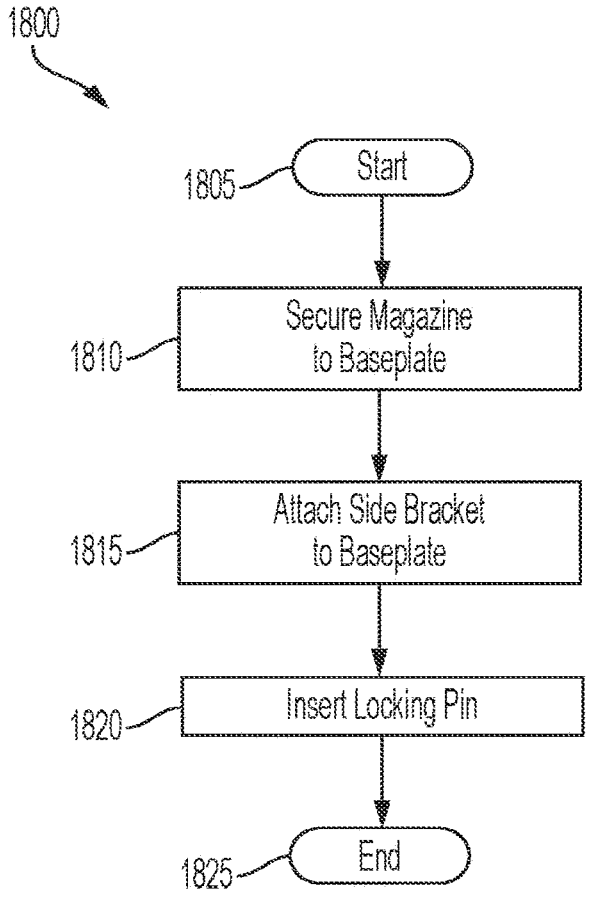
FIG. 18 is a diagram detailing a process for assembling the magazine extension of FIG. 13 on a magazine of a handgun.

Referring now to FIG. 18, there is shown a diagram detailing a process 1800 for assembling magazine extension 1300 on magazine 500 of handgun 600. The process begins at step 1805 and proceeds to step 1810, at which a user compresses magazine spring 515 of magazine 500, slides rails 510 of magazine 500 distally into securing slots 1430 of baseplate 1400, and releases spring 515 to permit engagement of spring 515 with floor 1415 of baseplate 1400. The process then proceeds to step 1815. At this step, the user urges engagement end 1510 of side bracket 1500 against the proximal side of magazine 500 and slides side bracket 1500 downwardly until post 1525 engages post receptacle 1445 of baseplate 1400 (see FIG. 16). The process then proceeds to step 1820, at which the user inserts locking pin 1600 laterally into through bores 1440, 1530 to secure side bracket 1500 to baseplate 1400 (see FIG. 17). The process then ends at step 1825.

Figure 19:
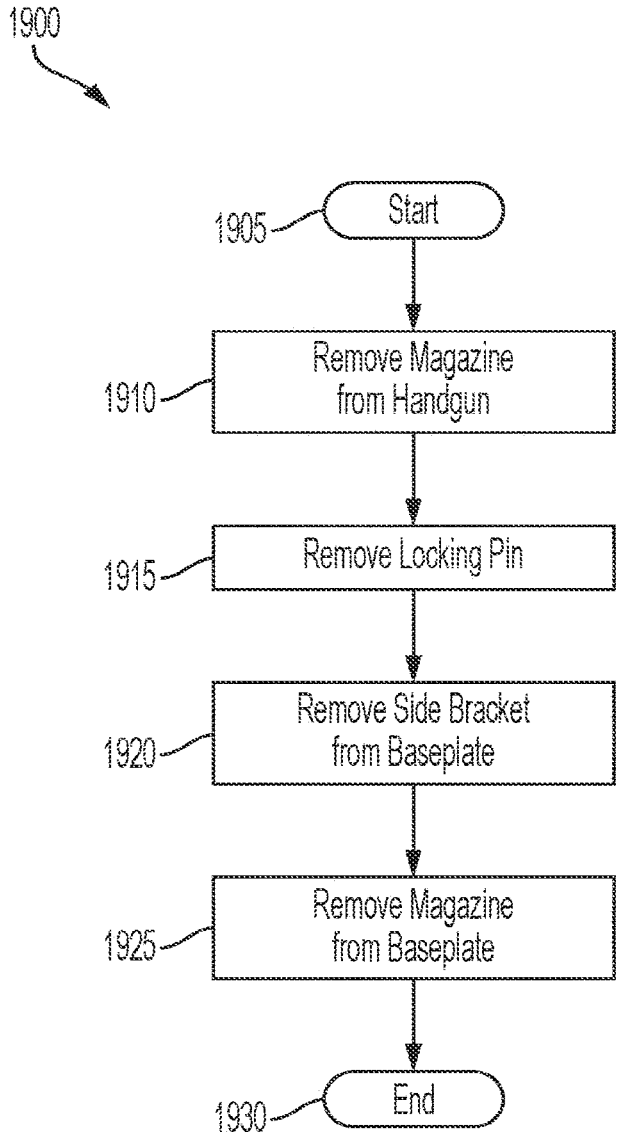
FIG. 19 is a diagram detailing a process for disassembling and removing the magazine extension of FIG. 13 from a magazine of a handgun.

Referring now to FIG. 19, there is shown a diagram detailing a process 1900 of removing magazine extension 1300 from magazine 500 of handgun 600. The process begins at step 1905 and proceeds to step 1910, at which a user removes magazine 500 from handgun 600 by depressing the magazine release button 615 of firearm 600 and sliding magazine 500 downwardly out of handgrip 605 (see FIG. 17). The process then proceeds to step 1915. At this step, the user inserts a fingernail, pin punch, ball point pen or other readily available tool or structure into through-bore 1440 to urge locking pin 1600 laterally out of magazine extension 1300. The process then proceeds to step 1920, at which the user slides side bracket 1500 upwardly along the proximal face of magazine 500 (see FIG. 16). Then, at step 1925, the user slides rails 510 of magazine 500 proximally out of securing slots 1430 of baseplate 1400. The process then ends at step 1930.

Referring now to FIGS. 20-25, there is shown another exemplary magazine extension 2000 in accordance with the subject disclosure. Similar to magazine extensions 100 and 1300, magazine extension 2000 increases the round capacity of magazine 500 of handgun 600 or other firearm. Magazine extension 2000 includes a baseplate 2100 for receiving open end 505 of magazine 500, a side bracket 2200 structured to releasably couple to baseplate 2100 for securing magazine 500 thereto and a locking pin 2300 for locking side bracket 2200 to baseplate 2100.

Unlike locking pin 1600 of magazine extension 1300, locking pin 2300 of extension 2000 includes two differently sized cylindrical portions 2305*a* and 2305*b* with different diameters interfacing at an annular stopping surface 2320. In the embodiment shown in the Figures, cylindrical portion 2305*b* has a diameter larger than that of cylindrical portion 2305*a*, with both portions 2305*a* and 2305*b* extending end-to-end between a large pin face 2310 and a small pin face 2315. It should be appreciated that portions 2305*a* and 2305*b* may be shaped differently and/or have differently shaped cross sections, such as, for example, triangular-shaped or square-shaped cross sections, though it will be understood that various embodiments are not intended to be limited to any particularly shaped portions 2305*a* and 2305*b*.

Figure 20:
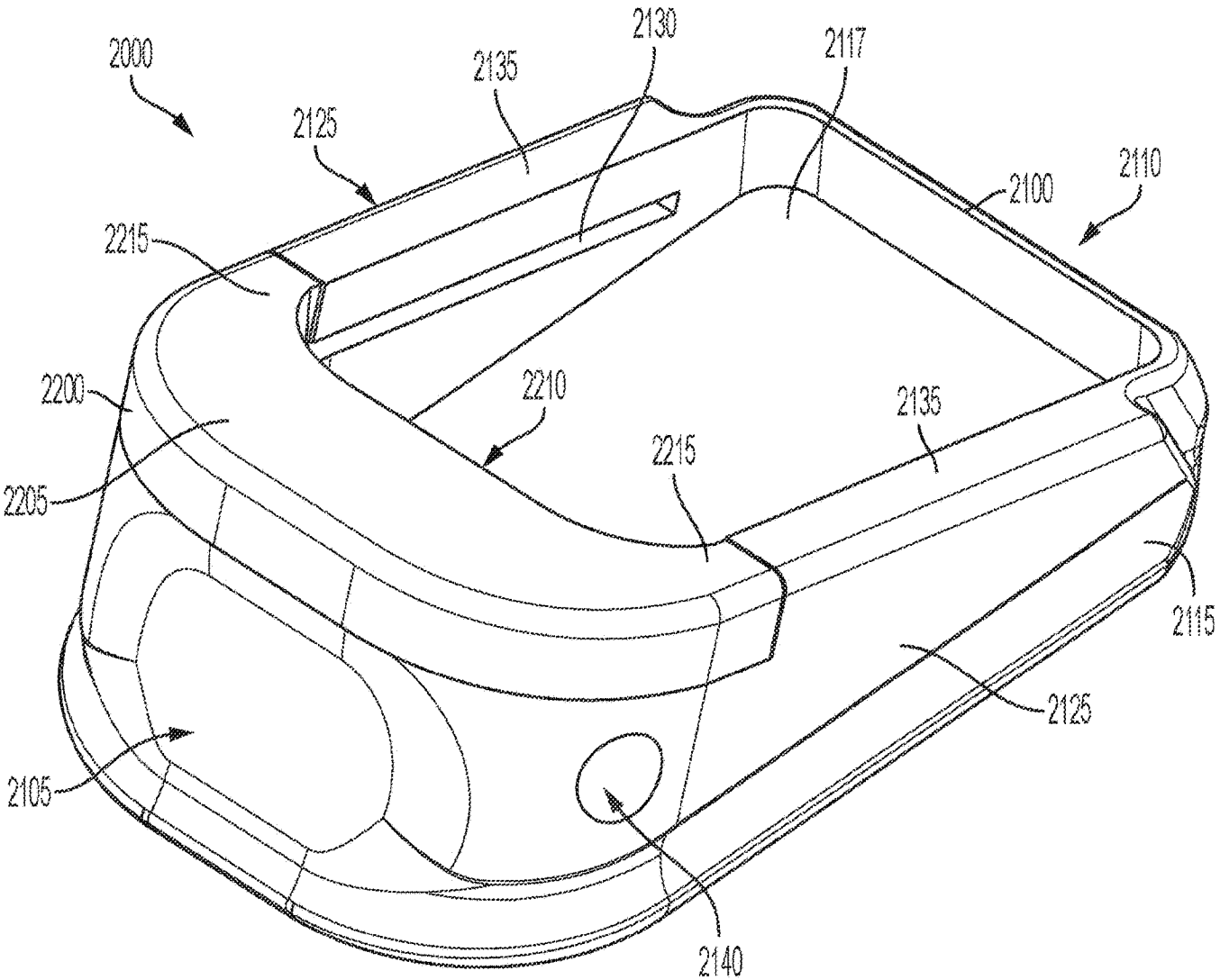
FIG. 20 is a perspective view of a magazine extension in accordance with still another exemplary embodiment of the subject disclosure.
Figure 21:
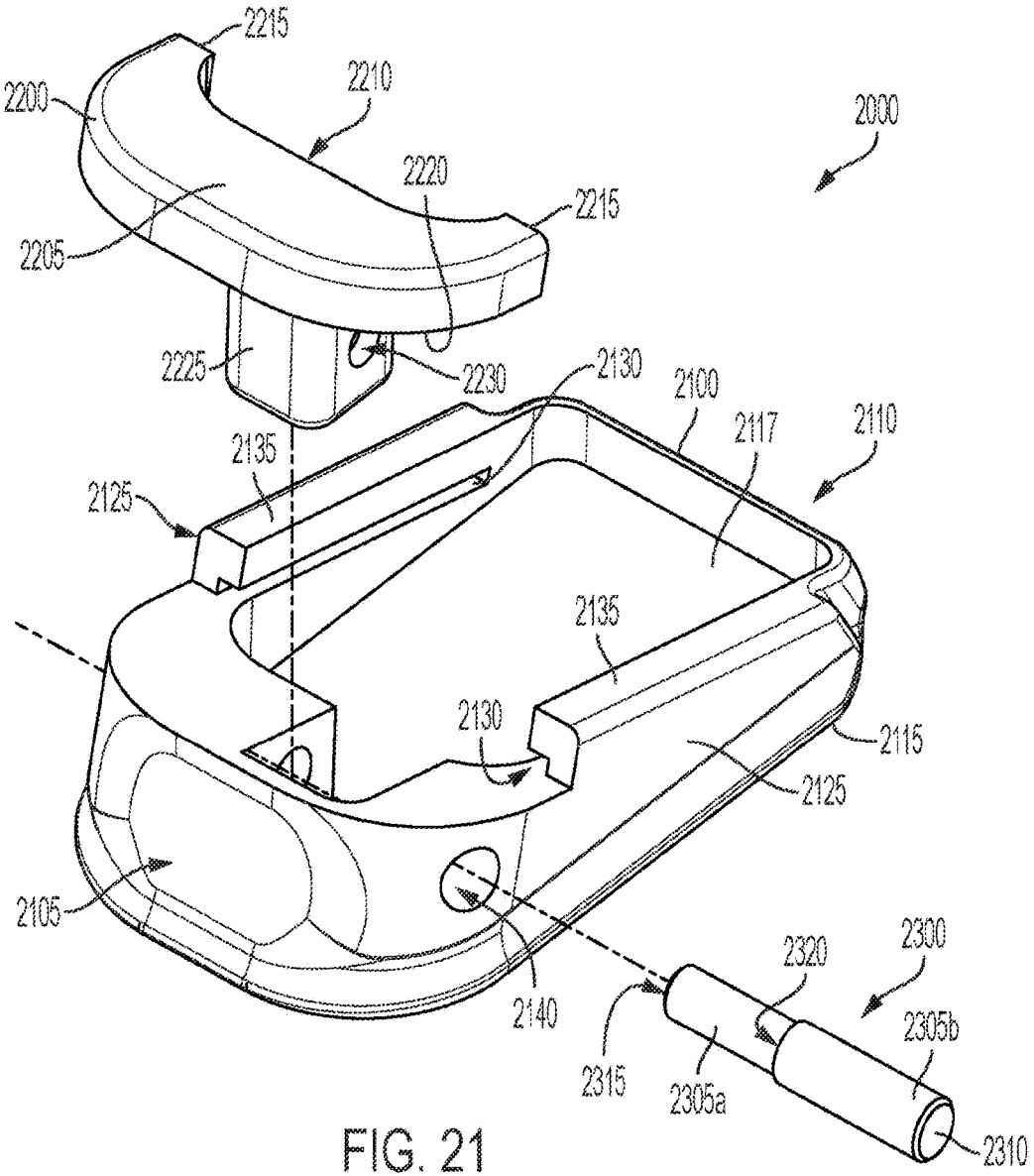
FIG. 21 is an exploded perspective view of the magazine extension of FIG. 20.
Figure 22:
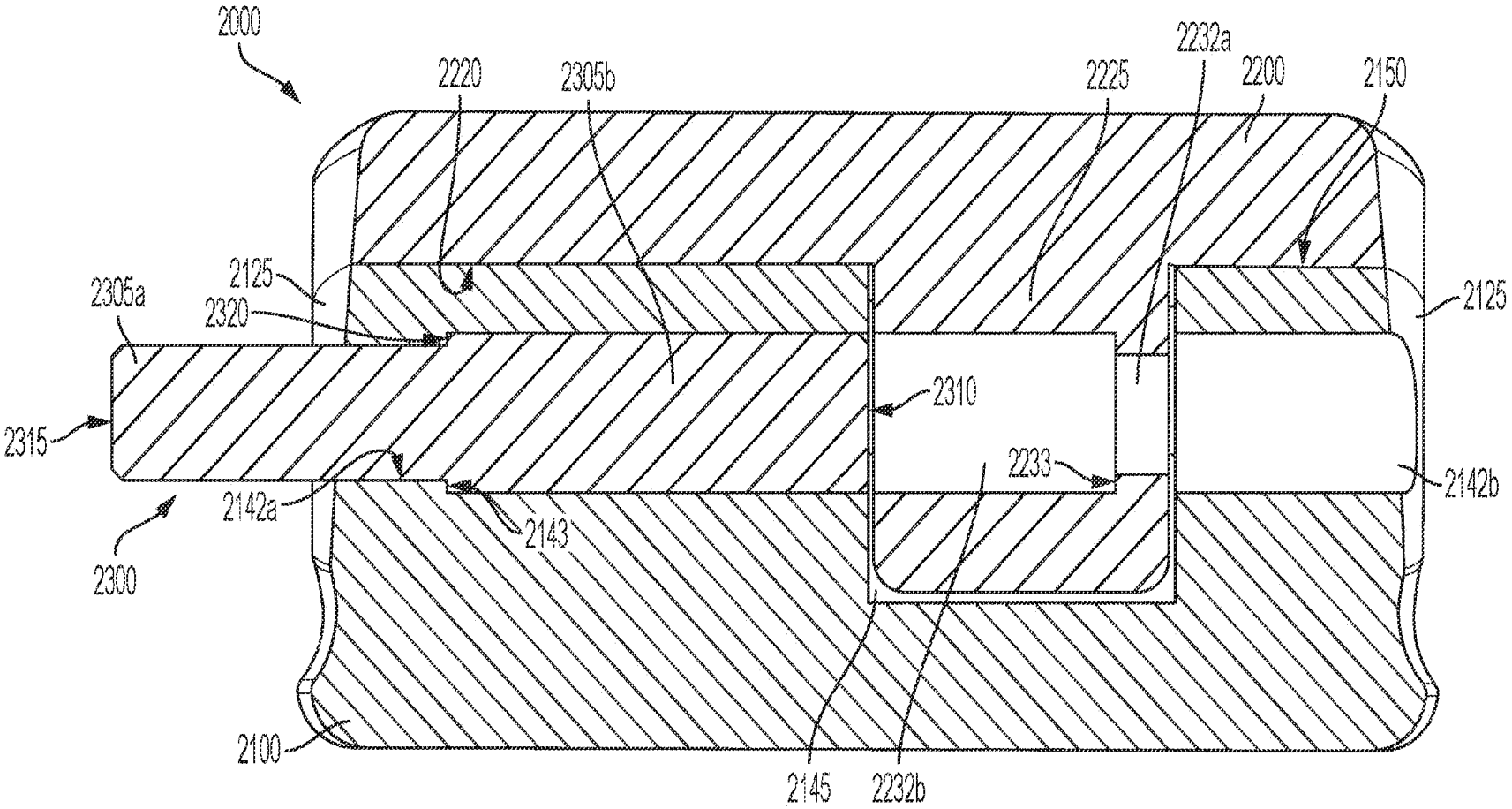
FIG. 22 is a front sectional view of the magazine extension of FIG. 20 having a locking pin in an unlocked position.
Figure 23:
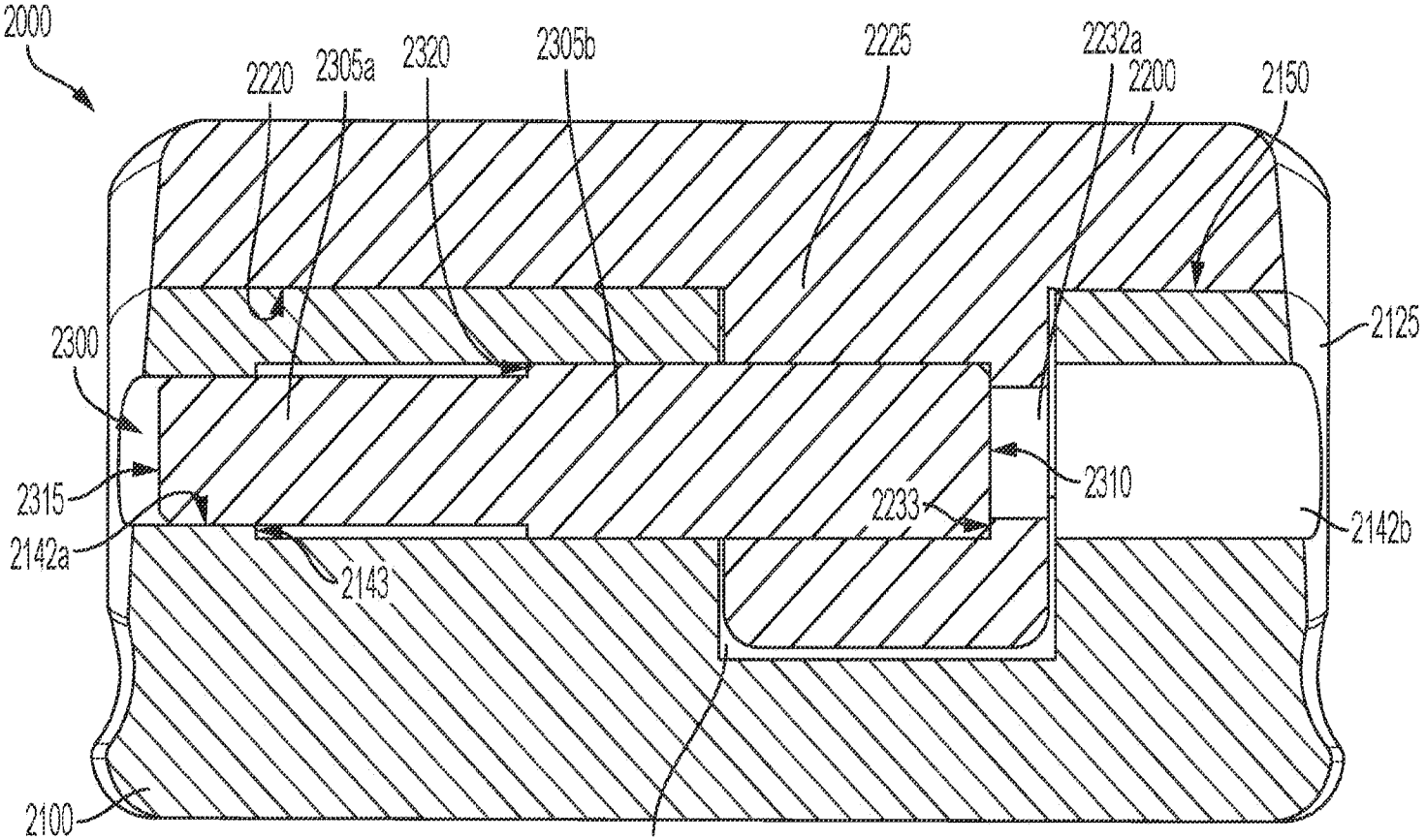
FIG. 23 is a front sectional view of the magazine extension of FIG. 20 with a locking pin in a secured position.
Figure 24:
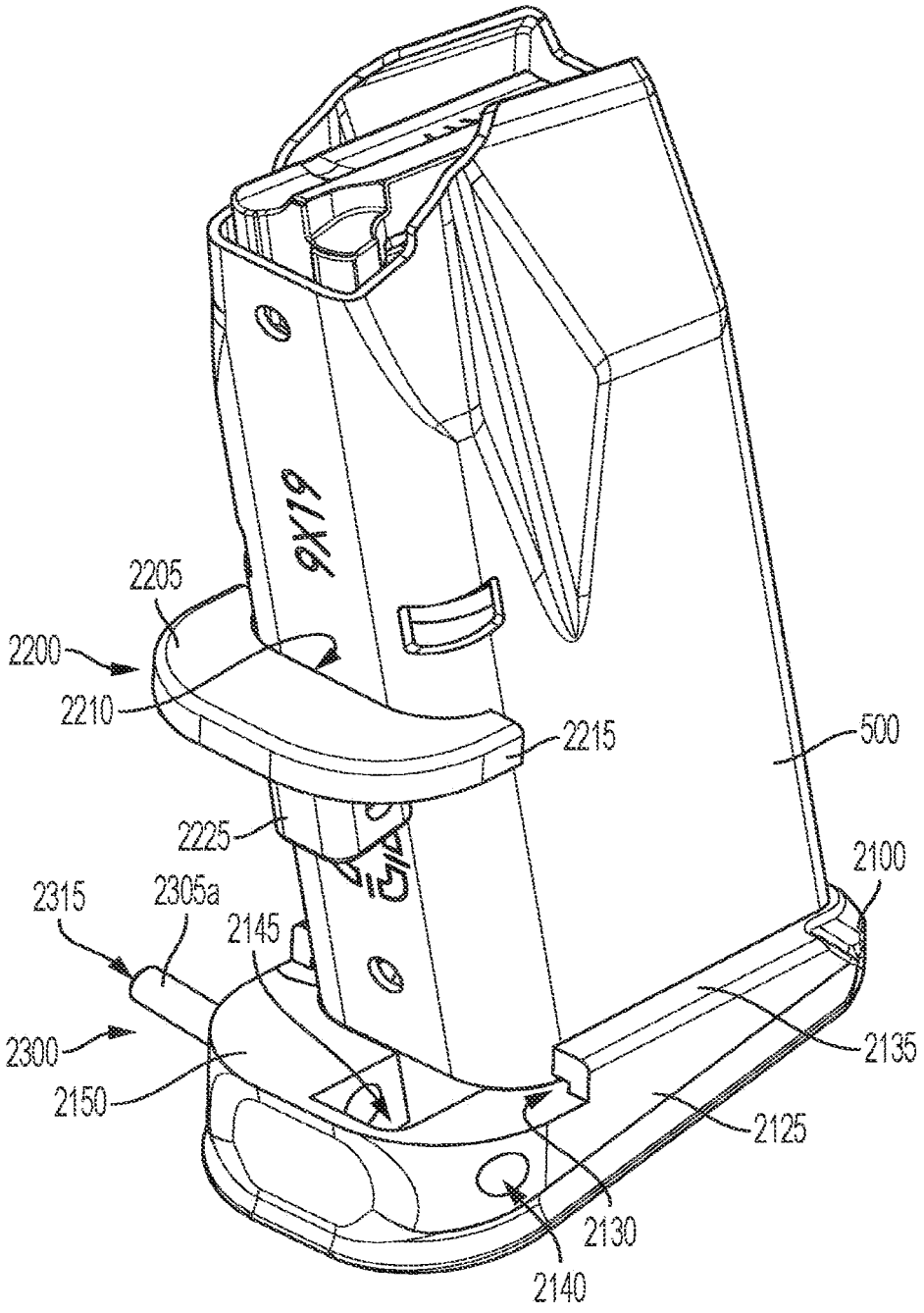
FIG. 24 is a perspective view of the magazine extension of FIG. 20 partially assembled onto a firearm magazine.
Figure 25:
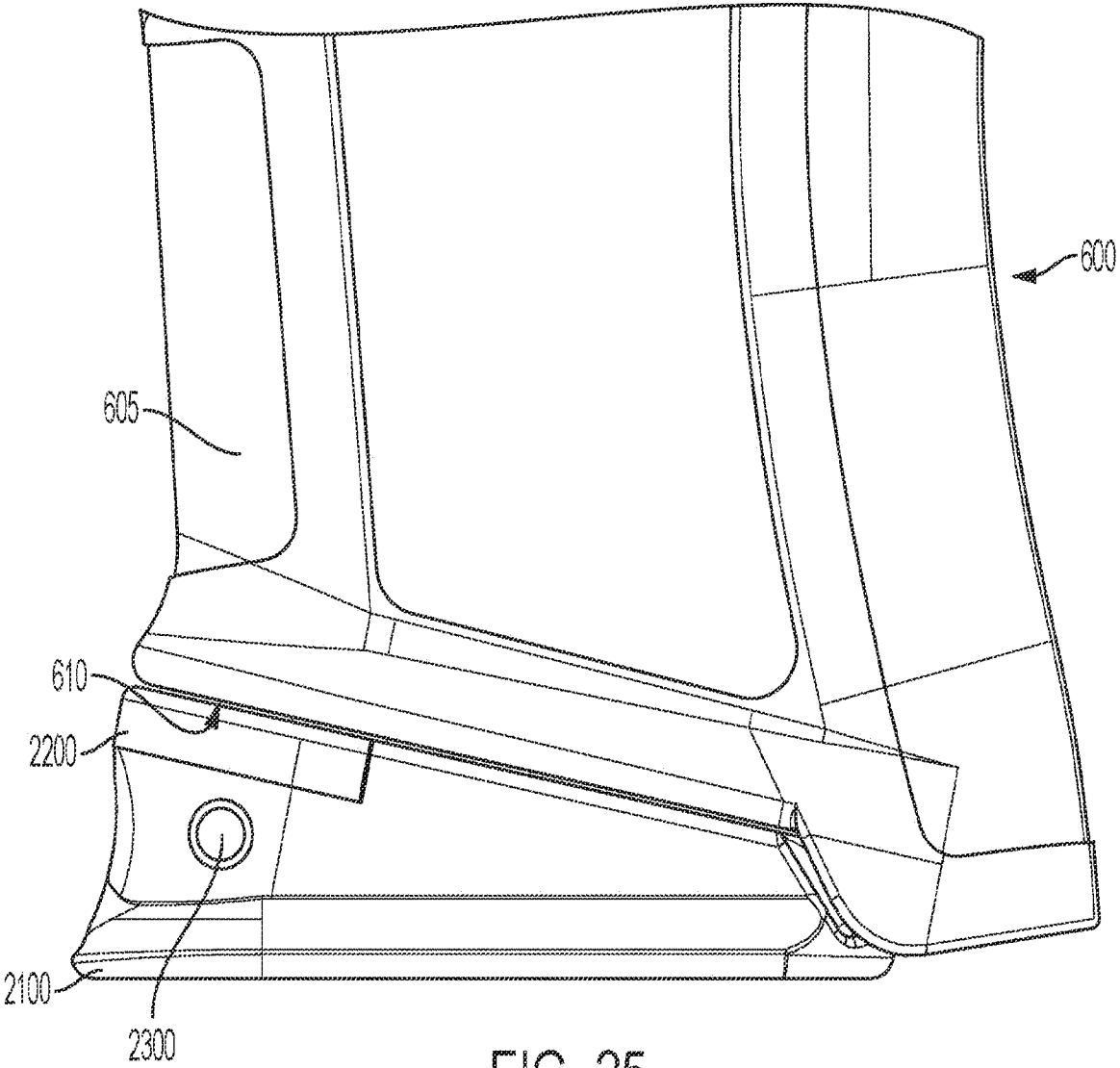
FIG. 25 is a side view of the magazine extension of FIG. 20 installed on a firearm magazine inserted and secured within a handgun.

As best shown in FIGS. 20 and 21, baseplate 2100 includes a proximal end 2105, a distal end 2110, a floor 2115 with an upper surface 2117 extending between proximal and distal ends 2105, 2110, two side walls 2125 at opposite lateral sides of floor 2115 and extending between proximal and distal ends 2105, 2110, an upwardly-facing mating surface 2150 at proximal end 2105, a post receptacle 2145 and a through-bore 2140 extending laterally through baseplate 2100 and intersecting post receptacle 2145 at proximal end 2105. Each side wall 2125 includes an inwardly projecting lip 2135 forming a securing slot 2130 sized to receive one of rails 510 of magazine 500. Baseplate 2100 and its features are formed integrally into one monolithic piece (such as by injection molding), though it should be appreciated that baseplate 2100 may be formed from multiple separate pieces and be constructed from any material(s) suitable for its intended purpose.

Unlike baseplate 1400 of magazine extension 1300, through-bore 2140 of baseplate 2100 includes two differently sized diameter bores 2142*a* and 2142*b* interfacing at an annular pin stop 2143. In the embodiment shown in the Figures, the diameter of bore 2142*a* is smaller than the diameter of bore 2142*b*, with bore 2142*a* extending only partially into one lateral side of side baseplate 2100. It should be appreciated that bores 2142*a* and 2142*b* may be shaped differently and/or have differently shaped cross sections, such as, for example, triangular-shaped or square-shaped cross sections to mate closely with locking pin 2300, though it will be understood that various embodiments are not intended to be limited to any particularly shaped bores 2142*a* and 2142*b*.

Side bracket 2200 includes a main body 2205 having a distally-facing engagement end 2210, two distally-facing stopping ends 2215 extending from respective lateral sides of engagement end 2210, and a downwardly-facing mating surface 2220. Side bracket 2200 further includes a post 2225 with a lateral through-bore 2230. Post 2225 extends downwardly from main body 2205 and is sized to engage with post receptacle 2145 of baseplate 2100. Like baseplate 2100, side bracket 2200 and its features are formed integrally into one monolithic piece, though it should be appreciated that side bracket 2200 may be formed from multiple separate pieces and be constructed from any suitable material(s)

Unlike side bracket 1500 of magazine extension 1300, through-bore 2230 of side bracket 2200 includes two differently sized diameter bores 2232*a* and 2232*b* interfacing at an annular pin stop 2233. In the embodiment shown in the Figures, the diameter of bore 2232*a* is smaller than the diameter of bore 2232*b*, with bore 2232*a* extending only partially into one lateral side of side bracket 2200. It should be appreciated that bores 2232*a* and 2232*b* may be shaped differently and/or have differently shaped cross sections, such as, for example, triangular-shaped or square-shaped cross sections to mate closely with locking pin 2300, though it will be understood that various embodiments are not intended to be limited to any particularly shaped bores 2232*a* and 2232*b*.

When magazine extension 2000 is secured to magazine 500, post 2225 of side bracket 2200 is closely received within post receptacle 2145 of baseplate 2100, such that through-bore 2230 of side bracket 2200 aligns with through-bore 2140 of baseplate 2100. In this position, locking pin 2300 extends laterally through both through-bores 2140, 2230 to secure side bracket 2200 to baseplate 2100. In the secured position, locking pin 2300 is limited in lateral movement on one side by engagement between large pin face 2310 and annular pin stop 2233 of side bracket 2200 and on the other side by engagement between stopping surface 2320 of pin 2300 and annular pin stop 2143 of baseplate 2100. In this manner, locking pin 2300 is prevented from inadvertently escaping extension 2000 during operation of handgun 600.

When in the secured position, mating surface 2220 of side bracket 2200 engages with mating surface 2150 of baseplate 2100, engagement end 2210 of side bracket 2200 engages with the proximal side of magazine 500, and stopping ends 2215 respectively close off the open ends of securing slots 2130 of baseplate 2100, thereby securing baseplate 2100 in place relative to magazine 500 and preventing baseplate 2100 from sliding distally off rails 510 of magazine 500. It should be appreciated that through-bores 2140, 2230 may be designed to slightly misalign with one another to ensure that locking pin 2300 bends slightly when inserted within magazine extension 2000, thereby frictionally maintaining pin 2300 in place when extension 2000 is secured to magazine 500.

Figure 26:
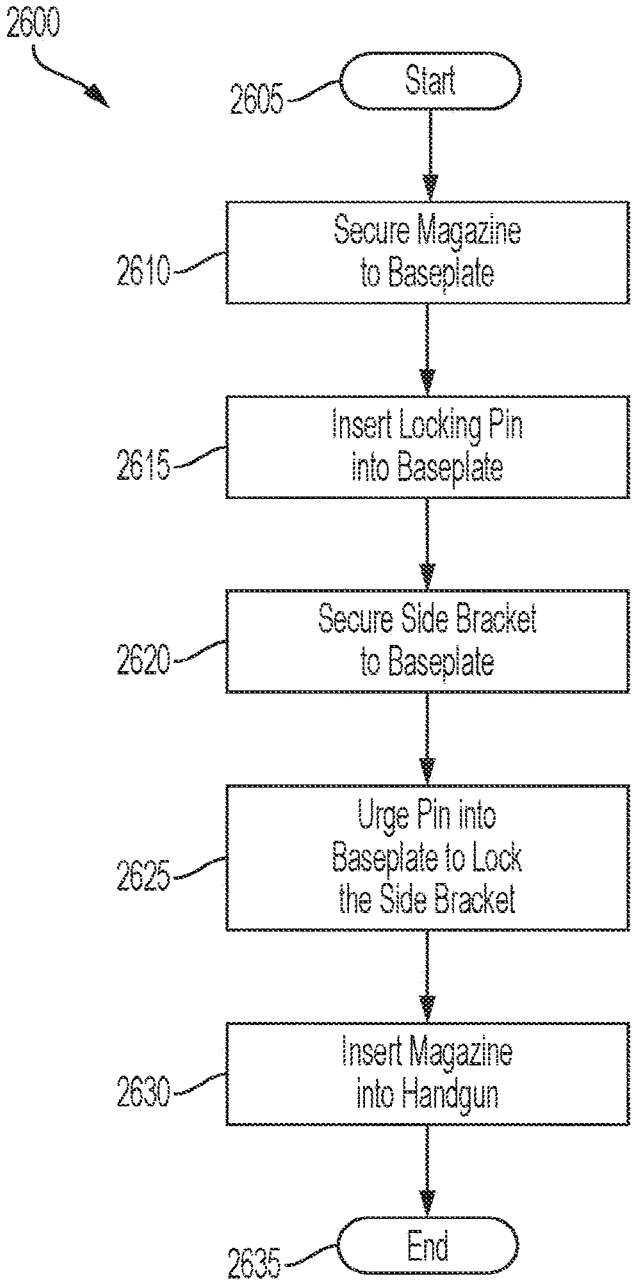
FIG. 26 is a diagram detailing a process for assembling the magazine extension of FIG. 20 on a magazine of a handgun.

Referring now to FIG. 26, there is shown a diagram detailing a process 2600 for assembling magazine extension 2000 on magazine 500 of handgun 600. The process begins at step 2605 and proceeds to step 2610, at which a user compresses magazine spring 515 of magazine 500, slides rails 510 of magazine 500 distally into securing slots 2130 of baseplate 2100, and releases spring 515 to permit engagement of spring 515 with floor 2115 of baseplate 2100. The process then proceeds to step 2615. At this step, the user inserts locking pin 2300 (smaller portion 2305*a* first) laterally into through-bore 2140 of baseplate 2100 until stopping surface 2320 of pin 2300 engages with pin stop 2143 of baseplate 2100 (see FIG. 24). In this position, small cylindrical portion 2305*a* protrudes laterally from side wall 2125 of baseplate 2100. The process then proceeds to step 2620. At this step, the user urges engagement end 2210 of side bracket 2200 against the proximal side of magazine 500 and slides side bracket 2200 downwardly until post 2225 engages post receptacle 2145 of baseplate 2100 (see FIG. 22). The process then proceeds to step 2625, at which the user engages small pin face 2315 to urge locking pin 2300 into extension 2000 until large pin face 2310 engages with pin stop 2233 of side bracket 2200, thereby securing side bracket 2200 to baseplate 2100 (see FIG. 23). Then, at step 2630, the user inserts and secures magazine 500 into handgun 600, at which position lower surface 610 of handgrip 605 prevents side bracket 2200 from sliding upwardly (see FIG. 25). In this way, embodiments of the present invention prevent inadvertent disassembly of extension 2000 during operation of handgun 600, even to the extent locking pin 2300 inadvertently dislodges laterally toward pin stop 2143 and out of through-bore 2230 of side bracket 2200. The process then ends at step 2635.

Figure 27:
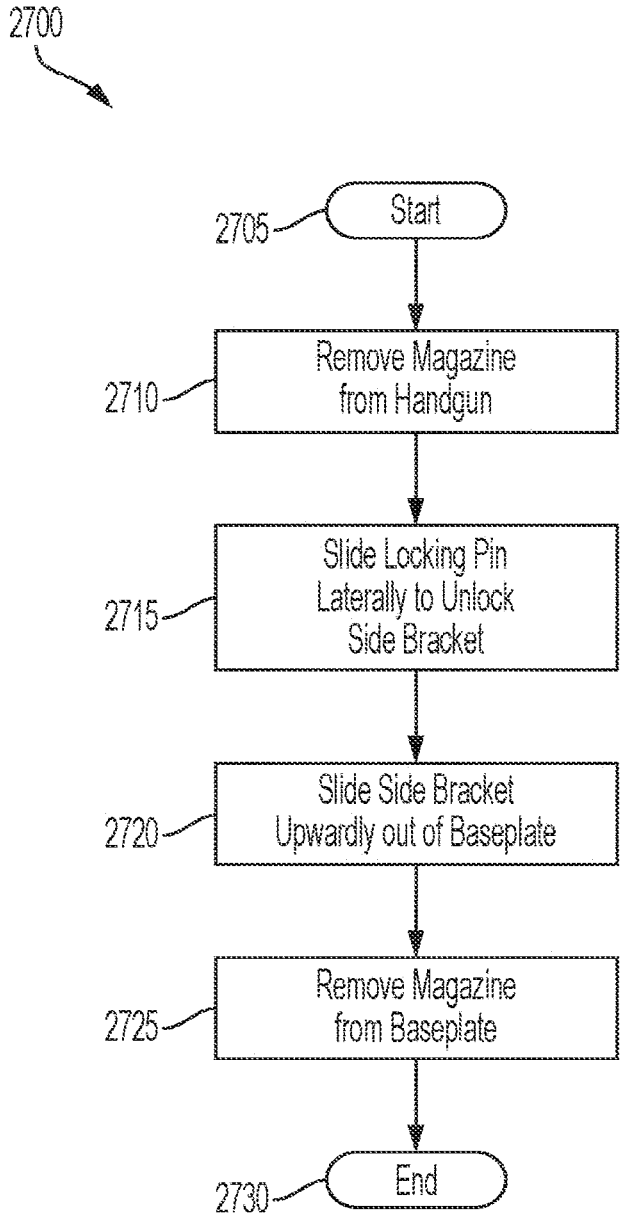
FIG. 27 is a diagram detailing a process for disassembling and removing the magazine extension of FIG. 20 from a magazine of a handgun.

Referring now to FIG. 27, there is shown a diagram detailing a process 2700 of removing magazine extension 2000 from magazine 500 of handgun 600. The process begins at step 2705 and proceeds to step 2710, at which a user removes magazine 500 from handgun 600 by depressing the magazine release button 615 of firearm 600 and sliding magazine 500 downwardly out of handgrip 605. The process then proceeds to step 2715. At this step, the user inserts a fingernail, pin punch, ball point pen or other readily available tool or structure into large bore 2142*b* of through-bore 2140 to urge locking pin 2300 laterally until stopping surface 2320 of pin 2300 engages with pin stop 2143 of baseplate 2100 (see FIG. 22). The process then proceeds to step 2720, at which the user slides side bracket 2200 upwardly along the proximal face of magazine 500 (see FIG. 24). Then, at step 2725, the user slides rails 510 of magazine 500 proximally out of securing slots 2130 of baseplate 2100. The process then ends at step 2730.

It should be appreciated by those skilled in the art that changes may be made to the exemplary embodiments described above without departing from the broad inventive concept thereof. It is to be understood, therefore, that this disclosure is not limited to the particular exemplary embodiments disclosed, but it is intended to cover modifications within the spirit and scope of the claims defined herein.

What is claimed is:

1. A magazine extension, comprising:

a baseplate structured to receive a lower open end of a magazine, the baseplate having two securing slots sized to receive respective rails of the magazine, each of the securing slots having an open end;

a side bracket releasably structured to couple to the baseplate for securing the magazine, wherein the baseplate and the side bracket are each formed into separate monolithic pieces; and an insertable locking pin which bends to lock the side bracket to the baseplate.

2. The magazine extension of claim 1, wherein the baseplate includes a floor having an upper surface positioned to engage a magazine spring of the magazine.

3. The magazine extension of claim 1, wherein the baseplate includes a post receptacle and the side bracket includes a post structured to be received within the post receptacle.

4. The magazine extension of claim 1, wherein the insertable locking pin includes a first portion having a first diameter, a second portion having a second diameter smaller than the first diameter, and a stopping surface at an interface between the first portion and the second portion.

5. The magazine extension of claim 1, wherein the insertable locking pin is limited in lateral movement on a side by engagement between a first pin face and a first annular pin stop of the side bracket.

6. The magazine extension of claim 5, wherein the insertable locking pin is limited in lateral movement on another side by engagement between a stopping surface of the insertable locking pin and a second annular pin stop on the baseplate.

7. The magazine extension of claim 1, wherein a lower surface of a handgrip prevents the side bracket from sliding upwardly.

8. The magazine extension of claim 1, wherein the side bracket includes a main body with an engagement end for engaging a proximal side of the magazine.

9. The magazine extension of claim 1, wherein the side bracket includes a stopping end to close an open end of a securing slot.

10. A magazine extension, comprising:

a baseplate structured to receive a lower open end of a magazine, the baseplate having a proximal end, a distal end and two securing slots sized to receive respective rails of the magazine, each of the securing slots having an open end;

a side bracket releasably structured to couple to the baseplate for securing the magazine, the side bracket having an engagement end for engaging a proximal side of the magazine, and two stopping ends to respectively close the open ends of the securing slots, wherein the baseplate and the side bracket are each formed into separate monolithic pieces; and an insertable locking pin which bends to lock the side bracket to the baseplate.

11. The magazine extension of claim 10, wherein the baseplate includes a floor having an upper surface positioned to engage a magazine spring of the magazine.

12. The magazine extension of claim 10, wherein the baseplate includes a post receptacle and the side bracket includes a post structured to be received within the post receptacle.

13. The magazine extension of claim 10, wherein the side bracket includes a stopping end to close an open end of a securing slot.

14. The magazine extension of claim 10, wherein a through-bore of the side bracket is mis-aligned with a through-bore of the baseplate when a post is closely received within a post receptacle of the baseplate.

15. The magazine extension of claim 10, wherein the insertable locking pin includes a first portion having a first diameter, a second portion having a second diameter smaller than the first diameter, and a stopping surface at an interface between the first portion and the second portion.

16. The magazine extension of claim 10, wherein the insertable locking pin is limited in lateral movement on a side by engagement between a first pin face and a first annular pin stop of the side bracket.

17. The magazine extension of claim 16, wherein the insertable locking pin is limited in lateral movement on another side by engagement between a stopping surface of the insertable locking pin and a second annular pin stop of the baseplate.

18. The magazine extension of claim 10, wherein a lower surface of a handgrip prevents the side bracket from sliding upwardly.

* * * * *